US005678716A

United States Patent [19]

Umiker

[11] Patent Number: 5,678,716

[45] Date of Patent: Oct. 21, 1997

[54] CONTAINER SYSTEM IN PARTICULAR A TRANSPORT CONTAINER AND/OR PACKAGING CONTAINER SYSTEM

[75] Inventor: Hans Umiker, Egg/ZH, Switzerland

[73] Assignee: Schoeller Plast S.A., Romont, Switzerland

[21] Appl. No.: 280,563

[22] Filed: Jul. 25, 1994

Related U.S. Application Data

[63] Continuation of Ser. No. 861,987, Jul. 29, 1992, abandoned.

[30] Foreign Application Priority Data

Oct. 26, 1990 [DE] Germany ..... 40 34 170.4
Nov. 27, 1990 [DE] Germany ..... 40 37 696.6

[51] Int. Cl.[6] ..... B65D 21/032

[52] U.S. Cl. ..... 220/4.26; 220/23.83

[58] Field of Search ..... 220/23.83, 23.86, 220/4.24, 4.21, 4.26, 4.29, 6, 324, 4.28; 217/13, 12 R, 45, 43 R

[56] References Cited

U.S. PATENT DOCUMENTS

| | | | |
|---|---|---|---|
| 701,576 | 6/1902 | Kirshner | 220/4.29 |
| 883,451 | 3/1908 | Collier | 217/13 |
| 889,899 | 6/1908 | Brown | 220/4.29 |
| 984,784 | 2/1911 | Tilton | 217/13 |
| 1,101,357 | 6/1914 | Thompson . | |
| 1,206,276 | 11/1916 | Wallach | 217/13 |
| 1,950,118 | 3/1934 | Lifton | 217/13 |
| 2,552,832 | 5/1951 | Ahlstrand et al. . | |
| 2,695,729 | 11/1954 | Hornish . | |
| 2,895,599 | 7/1959 | Moyer et al. | 217/13 |
| 2,980,280 | 4/1961 | Herlow | 220/23.8 |
| 2,989,226 | 6/1961 | Swartz | 220/4.28 |
| 3,088,787 | 5/1963 | Perkins . | |
| 3,266,655 | 8/1966 | Trunk | 220/4.24 |
| 3,561,666 | 2/1971 | Spinks et al. | 217/13 |
| 3,749,278 | 7/1973 | von Boch-Galhau | 220/23.83 |
| 3,935,931 | 2/1976 | Kaplan | 220/4.28 |
| 4,082,208 | 4/1978 | Lane, Jr. | 220/4.27 |
| 4,203,525 | 5/1980 | Okubo | 220/4.26 |
| 4,491,231 | 1/1985 | Heggeland et al. | 220/6 |
| 4,503,955 | 3/1985 | Fitzsimmons, Jr. . | |
| 4,619,363 | 10/1986 | Wolfseder | 220/4.27 |
| 4,724,756 | 2/1988 | Sarparanta | 220/4.26 |
| 4,960,149 | 10/1990 | Rizzitiello | 220/4.26 |
| 5,040,681 | 8/1991 | Grusin | 220/23.83 |
| 5,042,674 | 8/1991 | Ramsay et al. | 220/4.24 |
| 5,062,539 | 11/1991 | Chandler | 220/4.27 |
| 5,082,094 | 1/1992 | Nechushtan | 220/4.28 |
| 5,168,725 | 12/1992 | Margolin . | |

FOREIGN PATENT DOCUMENTS

| | | | |
|---|---|---|---|
| 335595 | 9/1903 | France . | |
| 2190682 | 2/1974 | France . | |
| 1034406 | 7/1958 | Germany | 220/4.26 |
| 209399 | 11/1966 | Switzerland | 220/4.26 |
| 518301 | 2/1940 | United Kingdom . | |
| 2033874 | 5/1980 | United Kingdom . | |

*Primary Examiner*—Stephen J. Castellano
*Attorney, Agent, or Firm*—Reese Taylor

[57] ABSTRACT

The invention relates to a modular container system consisting of mutually adapted basic elements that are identical with respect to certain dimensions so that they can be combined into different containers.

4 Claims, 23 Drawing Sheets

Figure 1:
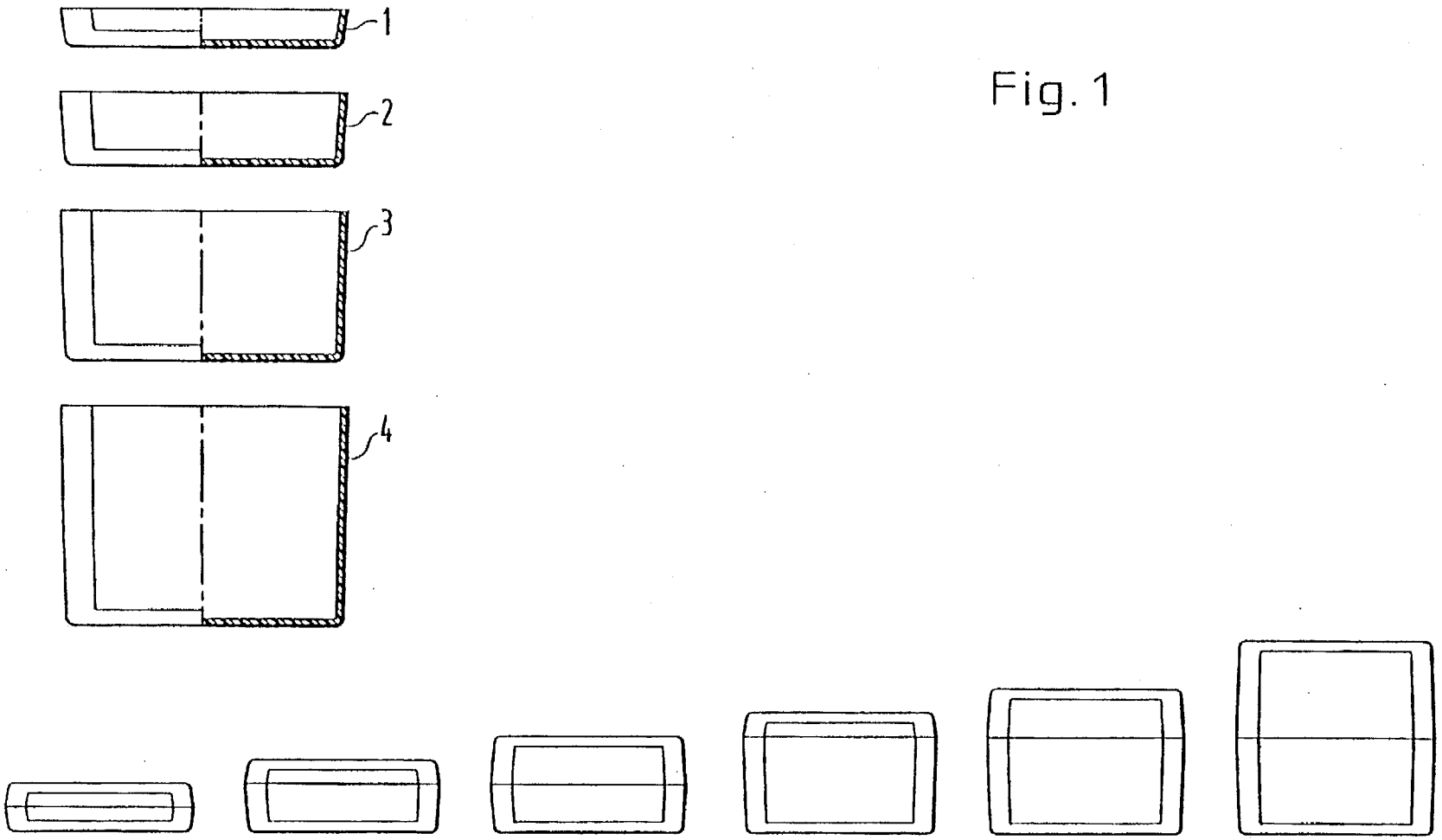

| TMSP | OUTSIDE | INSIDE | WALL |
|---|---|---|---|
| | 150 | 140 | 5 |
| | 200 | 185 | 7.5 |
| | 300 | 280 | 10 |
| | 400 | 370 | 15 |
| | 600 | 560 | 20 |

CONTAINER SYSTEM IN PARTICULAR A TRANSPORT CONTAINER AND/OR PACKAGING CONTAINER SYSTEM

This application is a continuation of application Ser. No. 07/861,987, filed Jul. 29, 1992 now abandoned.

The present invention relates to a universally applicable container system, in particular a transport container and/or packaging container system.

Customary carton packages are still mainly used today for transporting and otherwise storing goods, although they are disadvantageous in several respects. Firstly, the carton packages are not duly returned to the manufacturer but are instead passed on as waste material and at best recycled as waste paper. Carton packages are unsuitable as returnable packages. In addition, such packaging systems are unstable: in particular if moisture enters a softening of the carton packages must be feared so that the goods might fall out during transport or storage.

The invention is based on the problem of developing a container system which is applicable in manifold ways, easy to handle, of robust construction, suitable as a returnable package, and also easy to produce.

According to the invention the container system is constructed of modular basic elements. These basic elements can be combined with one other to form containers. There is a wide variety of possible combinations starting out from only a few basic elements. The basic elements are preferably made of plastics, resulting in a stable large-box container system. An advantage of the containers or basic elements described in detail in the description is that, with a container composed of two basic elements, for example, the upper element can be removed and the lower element then used as a display element on a store shelf or the like, optionally with an intermediate frame disposed thereon. It is also very simple to open the container: one need only remove the uppermost basic element or take it off laterally. The basic elements are preferably graduated in height, so that a very great number of possible variations results for a container using, for example, only four modular basic elements of different heights.

Suitable fastening mechanisms, such as tightening straps, strings and the like, but in particular snap elements, tightening elements, catches and tongue-and-groove joints, permit a fixation of the container, that can be unlocked for removal of the goods. In an advantageous embodiment these fastening means can also be an immediate component of one of the modular components. e.g. form the frame element if joints are provided in the corners of the frame element and a buckle-like tightening and locking element is provided that forms a frame element wall.

The basic elements are characterized in particular by a bottom and surrounding side walls of different heights, whereby frame elements can expediently be added that have no bottom and thus serve to increase the container height.

Altogether these measures result in a number of advantages. The basic elements are stackable in one another, in particular due to a slightly conic design of the side walls, so that they require little room also when being returned. The elements can be used as display packages, so that the container with the goods can be put directly on a shelf. Further advantages are the stable design and the weather resistance, as well as the suitability of these systems for repeated use after being returned to the manufacturer. The system is also characterized by a great variety of possible combinations due to the modular structure using basic elements. In addition, these basic elements result in a closed package or container, so that the goods are protected from the outside. The package is also suitable for taking up advertising and the like. Finally, handles can be provided in the side walls in the form of recesses. Also, the plan form of the containers is geared to the dimensions of available pallets, so that a great number of containers can be accommodated on one pallet without projecting beyond it. The basic elements of low height can be used as trays or covers, and the basic elements with greater height as troughs and the like.

In the following, preferred embodiment examples of the invention shall be described with reference to the drawing, in which FIGS. 1 to 6 show various views and combinations of basic elements of a container system, FIGS. 7 to 14 show views of basic elements and combinations of these elements in a further embodiment of a container system, FIGS. 15 to 20 show views of basic elements and combinations of these elements in a further embodiment of a container system, FIGS. 21 to 24 show views of basic elements and combinations of these elements in a further container system of the invention, and FIGS. 25 to 33 show further details.

FIG. 1 shows an overall view of an embodiment of a container system of a preferred embodiment example with altogether four basic elements of similar structure but different height, Basic elements 1 to 4, that are combinable with each other in any desired manner, are shown in FIG. 1 on the left from the outside and on the right in cross section. Basic element 1 is formed by a flat container with a rectangular plan form and has four surrounding side surfaces and a container bottom. Elements 2 to 4 differ from basic element 1 in the height of the side walls. The side walls are inclined outwards slightly conically from the bottom to the top, so that the empty basic elements can be stacked in one another in space-saving fashion.

FIG. 1 shows at the bottom various combinations of basic elements assembled to form containers of different sizes. One can see that the four basic elements 1 to 4 can be used to realize a wide range of possible combinations.

If required, the basic elements assembled into a container can be locked, e.g. if the containers have a slightly overlapping design or tongue-and-groove joints are formed on the opposing faces. However, the stacked basic elements can also be fixed by tightening straps, strings, packaging films and the like. The advantage of the container system is not only the great number of possible variations but also that the transport containers can at the same time be used as display containers, e.g. if the container is deposited on a shelf and the upper basic element removed. The design of the basic elements is such that they can all be combined with one other.

Figure 2:
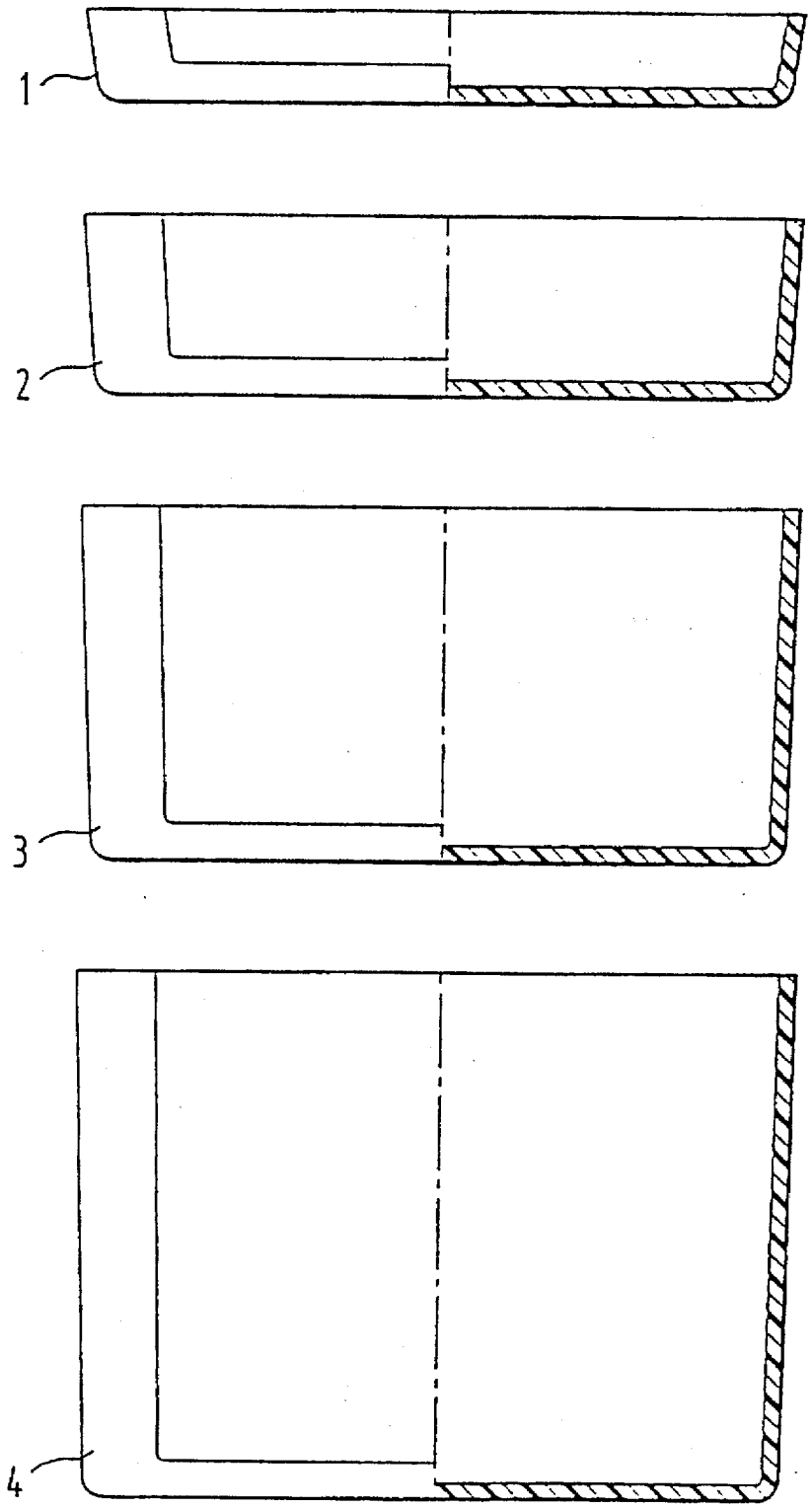
Figure 3:
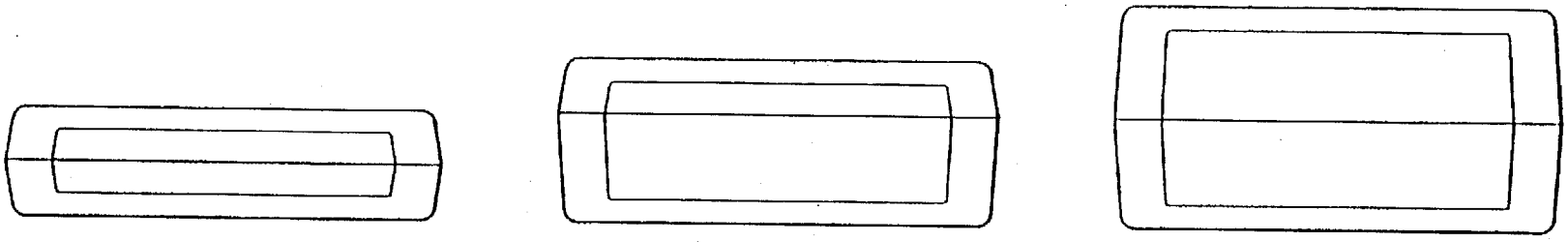
Figure 4:
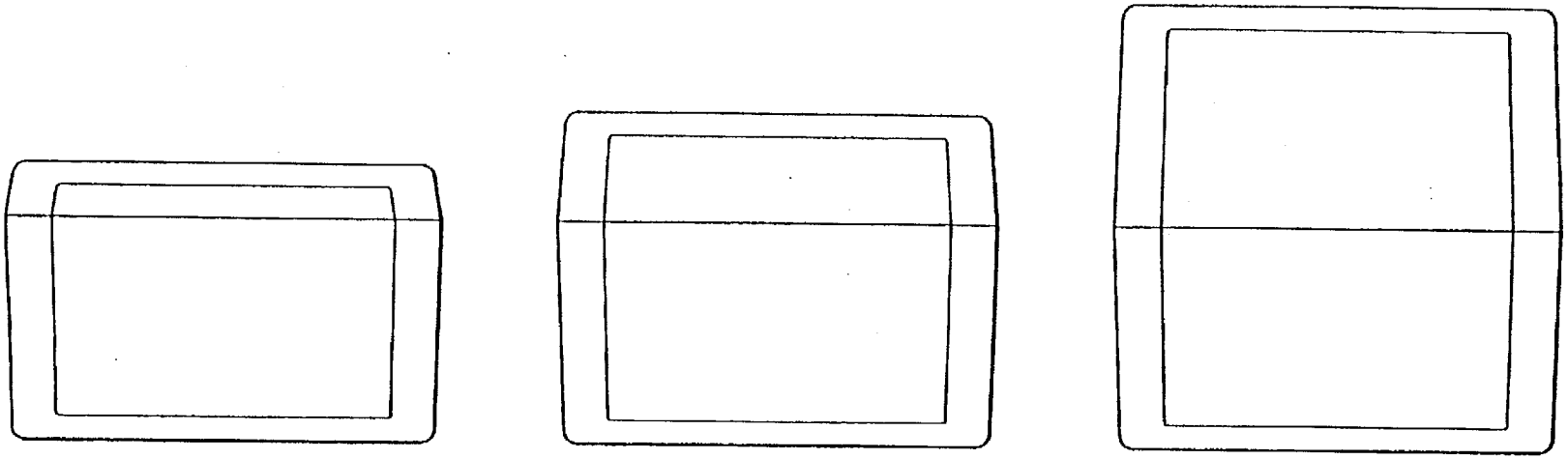

FIG. 2 shows a larger representation of basic elements 1 to 4. FIG. 3 shows three examples of combination, a flat container being formed on the left by stacking two basic elements 1, a medium-size container by stacking basic elements 2 and 1, and a somewhat higher container by stacking two basic elements 2. FIG. 4 shows on the right a container composed of two basic elements 4. The container disposed beside it is formed of a basic element 3 and a basic element 2 placed upside down thereon. The container located next to it results from placing a basic element 1 on the top instead of basic element 2.

Figure 5:
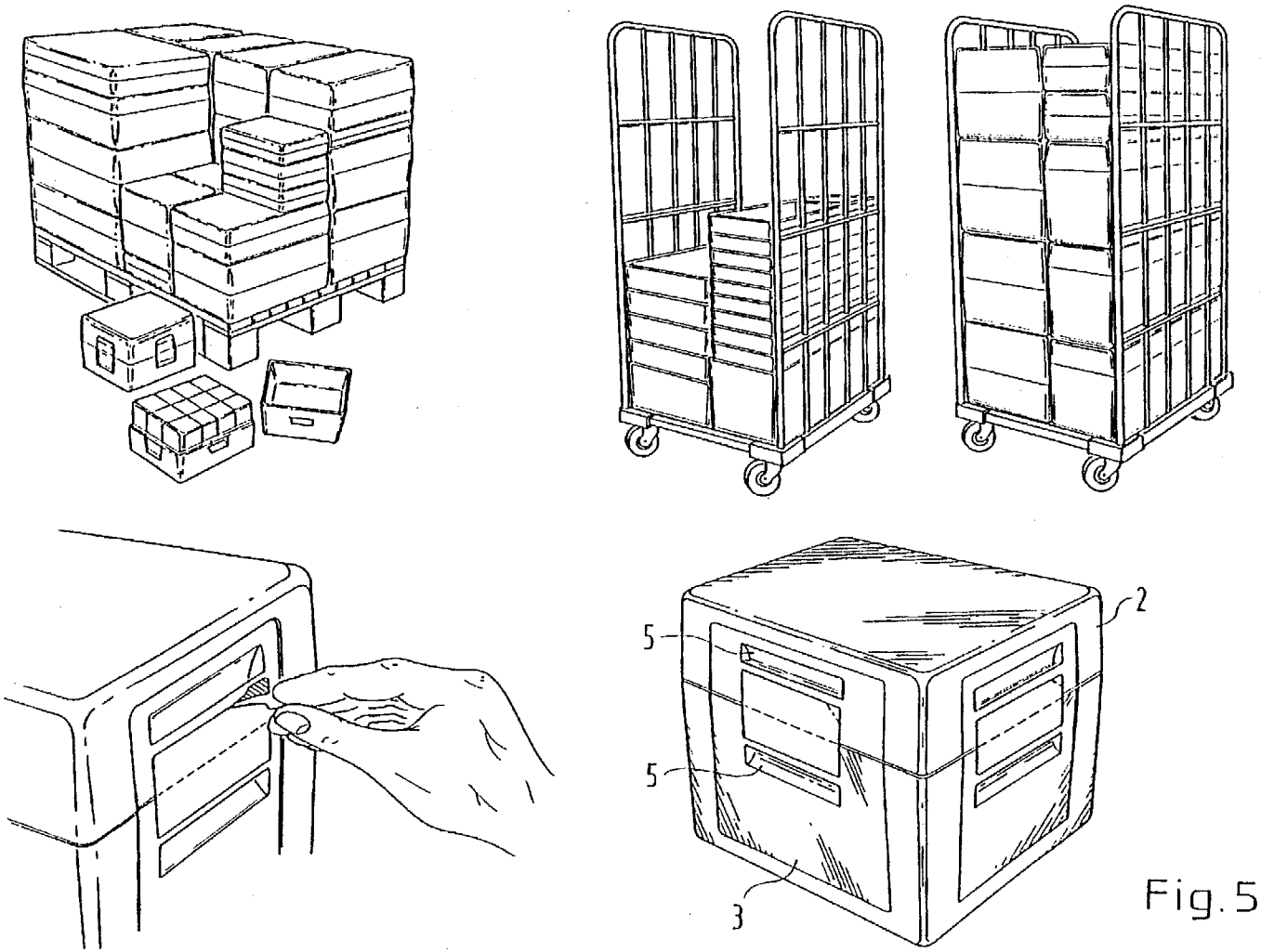

FIG. 5 shows a container formed of a basic element 3 and 2, that is stacked on further containers composed of basic elements. Recesses 5 can be provided here in the side walls of the basic elements to form handles. FIG. 5 shows on the top left that a great number of different containers, each constructed of basic elements 1 to 4, can be stacked on a pallet. In FIG. 5 on the top right one can see that containers can be transported in very space-saving fashion in the empty state because the basic elements can be stacked in one another in accordance with their conic design.

Figure 6:
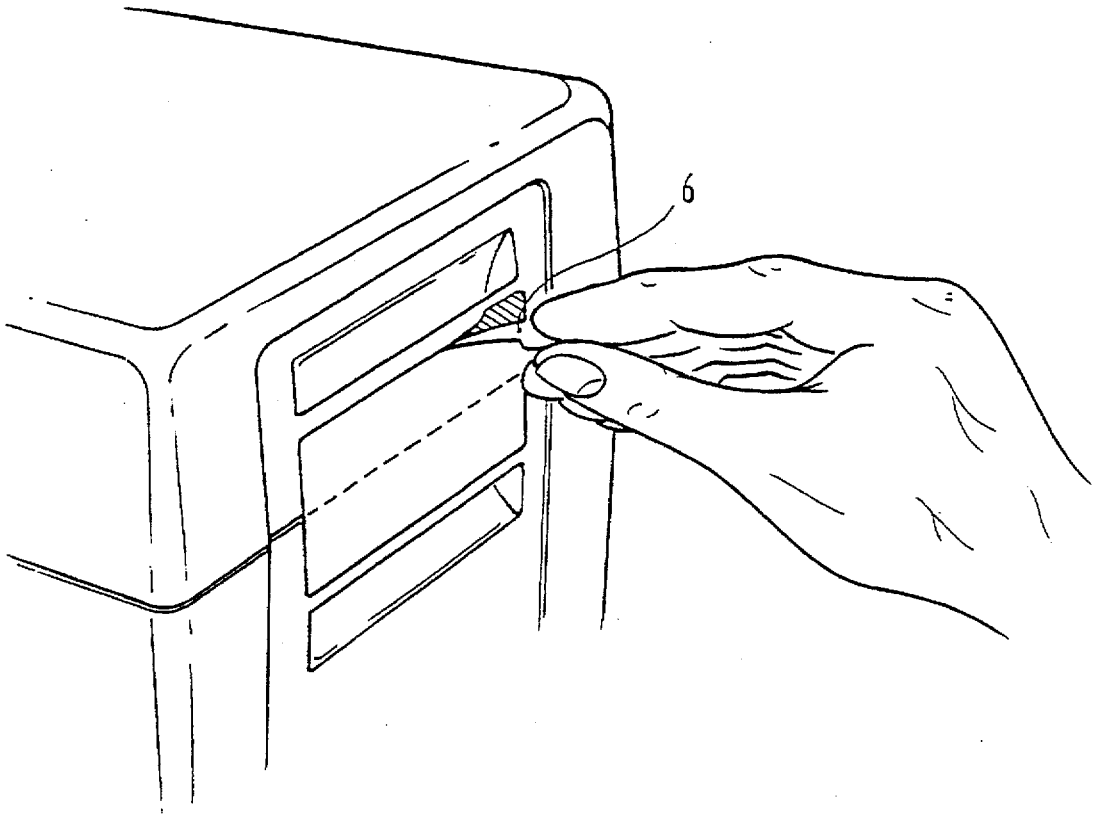

FIG. 5 shows on the left an example of a lock for the two assembled basic elements, which is shown larger in FIG. 6. A great variety of fastening mechanisms for fixing the two basic elements to each other can be realized here. FIG. 6 shows a bolt that acts on a tightening element or a hook element so that upon operation of the bolt or pivoted lever 6 the fixation of the two basic elements can be detached and the upper basic element thus lifted off the lower basic element.

Figure 7:
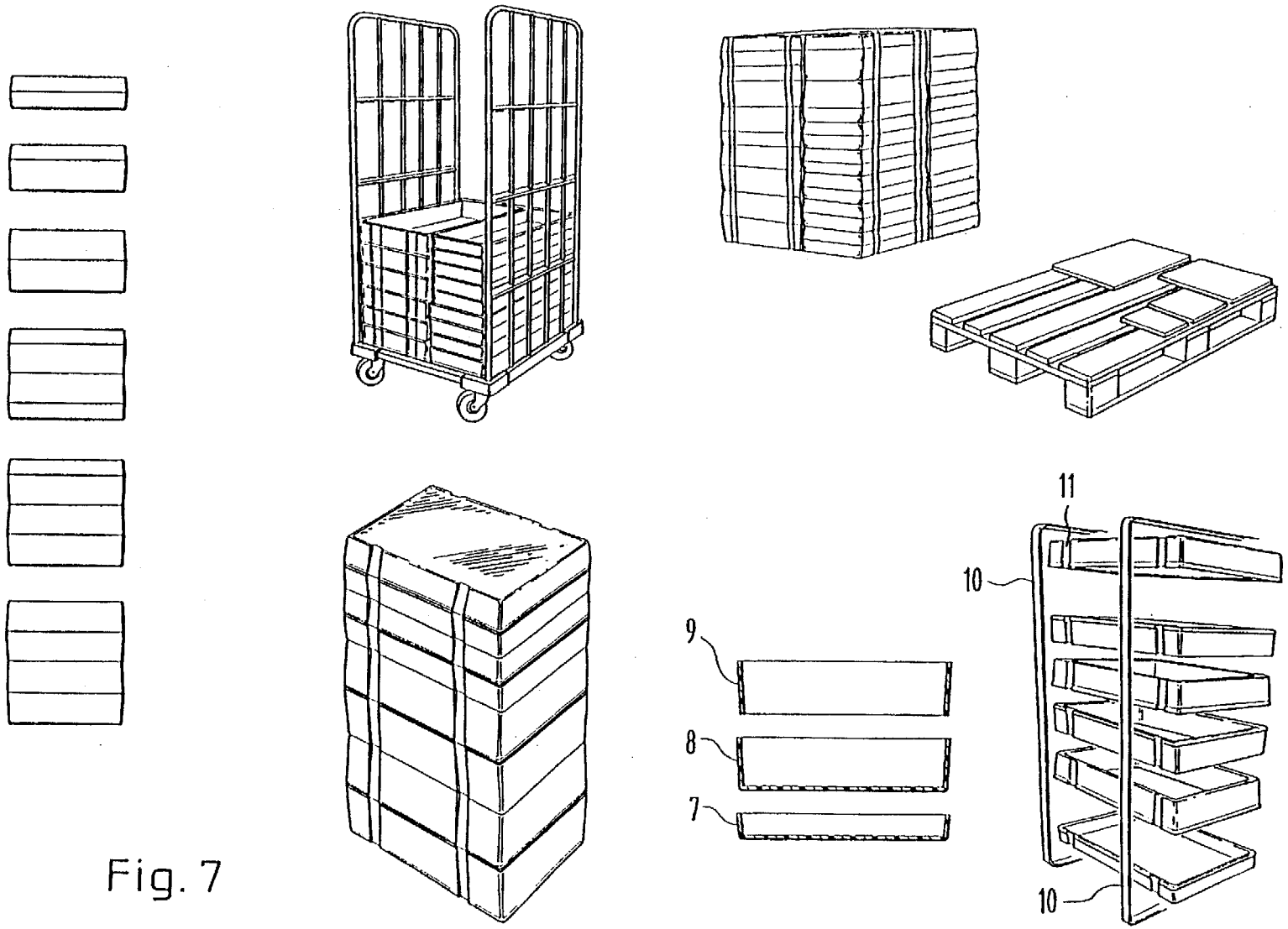

The further embodiment example of a container system described with reference to FIGS. 7 to 14 will be described with reference to three basic elements 7 to 9. FIG. 7 shows an overall view of the container system, basic elements 7 to 9 being featured in the middle. Basic element 7 is a flat dish-shaped basic element comprising a bottom with four surrounding side walls, the bottom having a rectangular plan form. The side walls are again inclined outward slightly conically. Basic element 7 can serve as a cover. Basic element 8 is of similar construction to basic element 7 but the side walls are higher. In the embodiment example basic element 7 has side walls with a height of 37.5 mm, whereas the height of the side walls of basic element 8 is twice as great. Finally. 9 refers to a frame element whose construction is analogous to that of basic element 8 but has no bottom. In the embodiment example shown, this frame element has side walls with a height equal to the height of the side walls of basic element 8. Greater heights can of course be realized if required, e.g. a frame element which is twice as high as frame element 9. Due to the conical design of the basic elements they can be stacked very favorably in one another in the empty state again, as indicated by the top left representation in FIG. 7. On the far left in FIG. 7 one can see various examples of combination, each composed of basic elements 7 to 9. Depending on how many frame elements 9 are inserted containers of any desired size can be realized. FIG. 7 shows on the right an exploded representation of a container consisting of a lower basic element 7, four frame elements 9 and a cover element placed thereon, either element 7 or 8. By removing or adding the frame element one can realize this container. The basic elements are fastened into a container in the shown embodiment example by winding tightening straps 10 around the basic elements. As indicated in particular by FIG. 10, corresponding recesses 11 are formed for this purpose in the side walls of the basic elements. This permits the tightening straps to be taken up flush and not to protrude beyond the outer surface of the container formed of the basic elements. Instead of such tightening straps one can also use strings and other fastening elements. The tightening straps have the advantage that they prevent a third person from using the basic elements as a container because others usually have no packaging apparatus with tightening straps available. This excludes "second use," thereby ensuring that the containers are returned. FIG. 7 finally also shows that the basic dimensions of a basic element are preferably 200×150 mm, which permits the containers to be accommodated well on standard European pallets, also in offset stacking. The basic elements can of course also be designed with other dimensions, it being again preferable to use an integral multiple of the dimensions of 200×150 mm.

Figure 8:
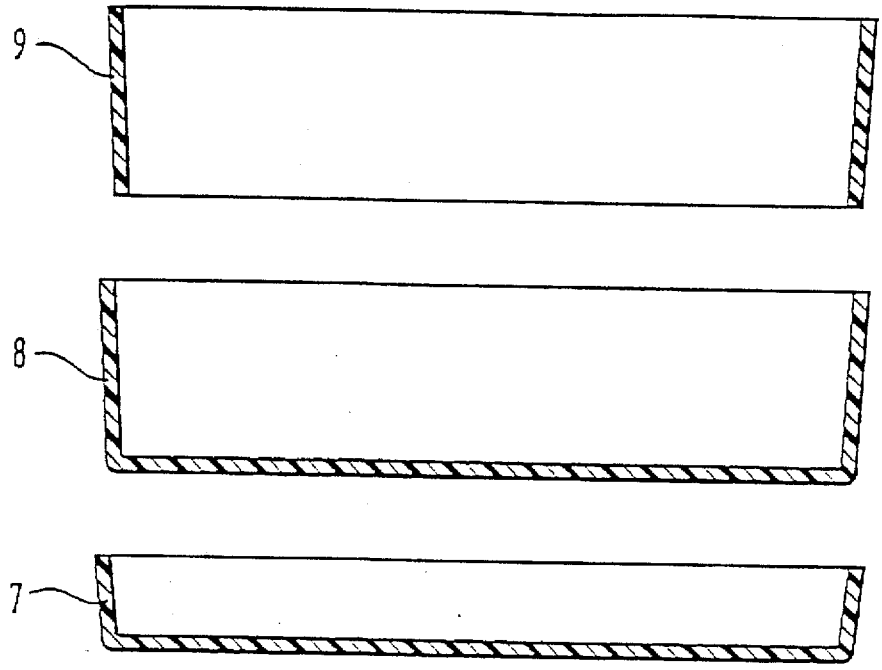
Figure 9:
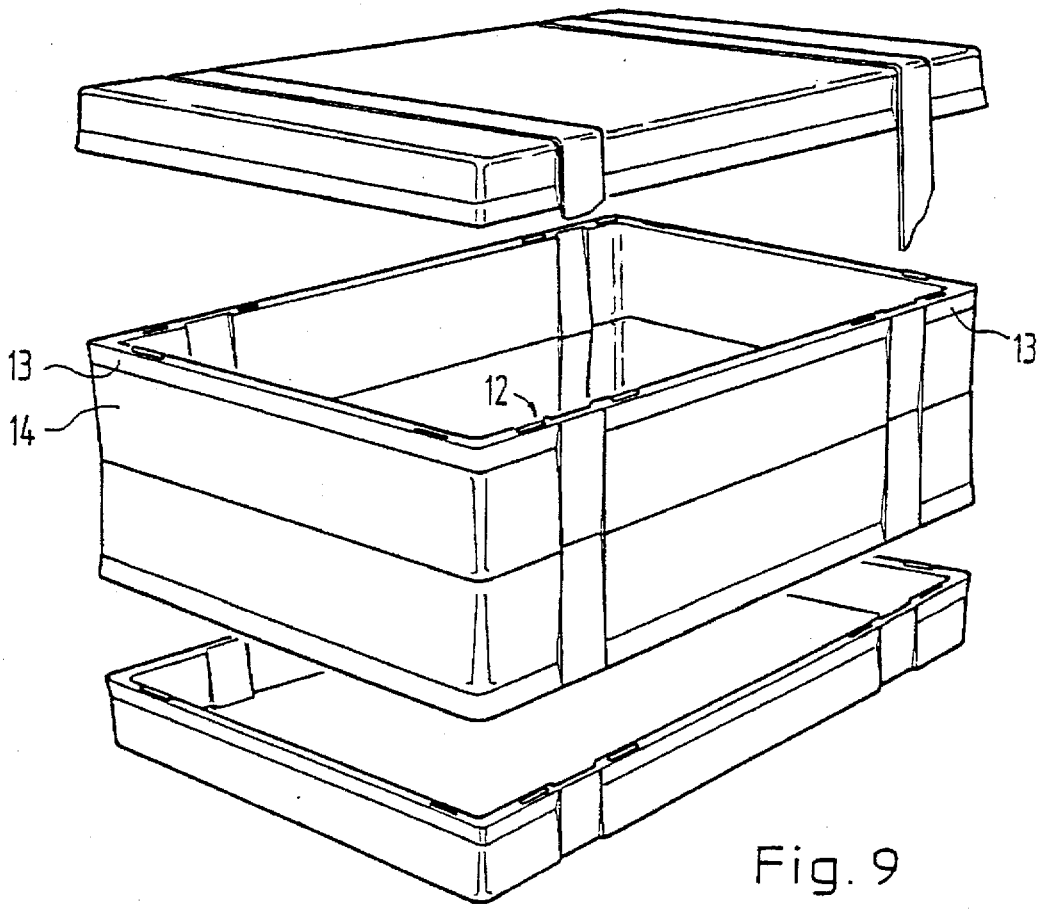
Figure 10:
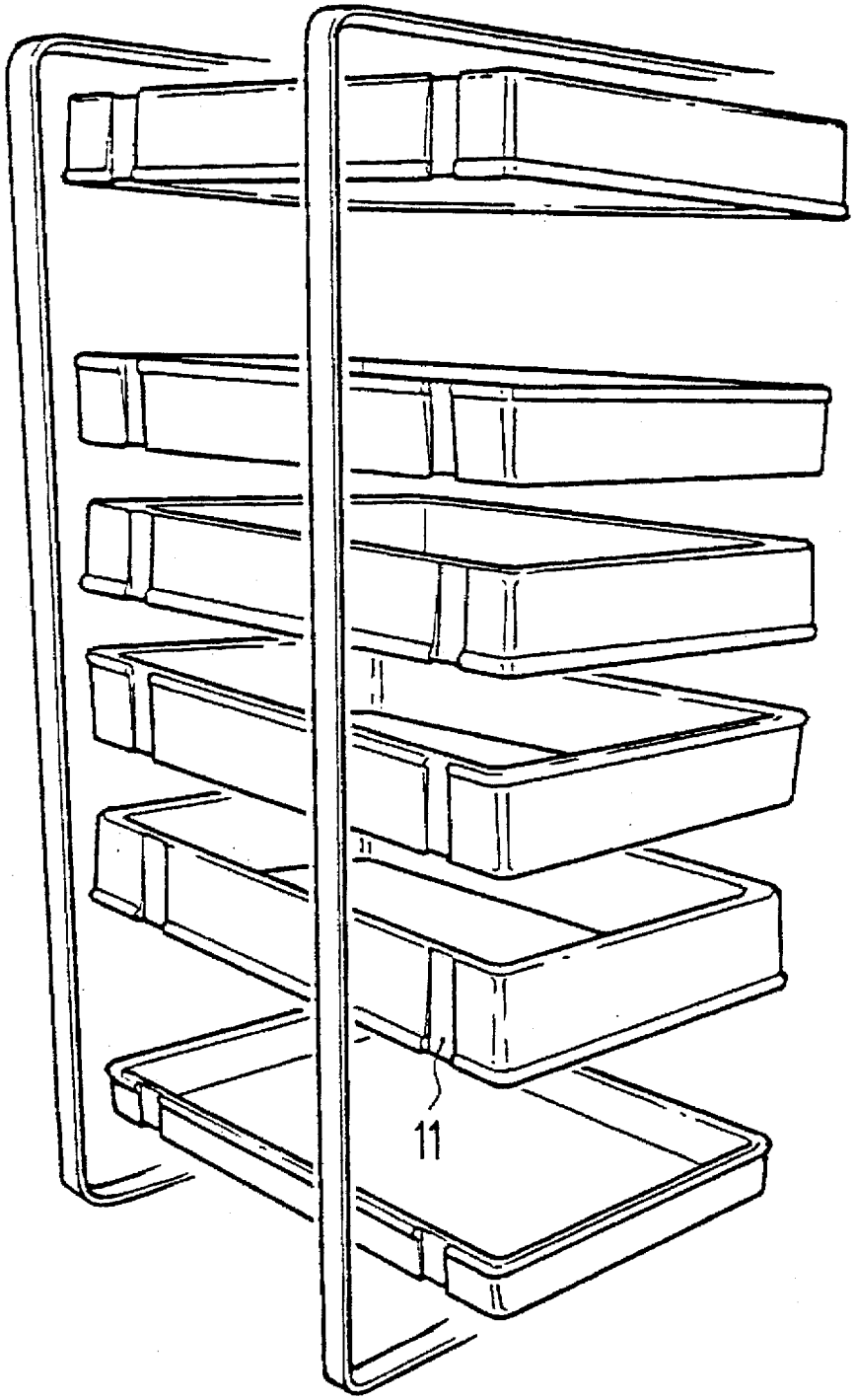
Figure 11A:
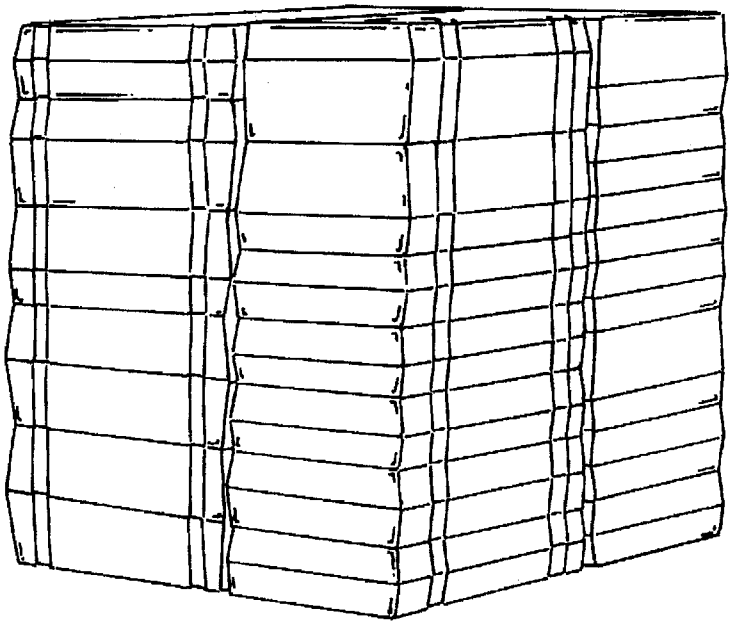
Figure 11:
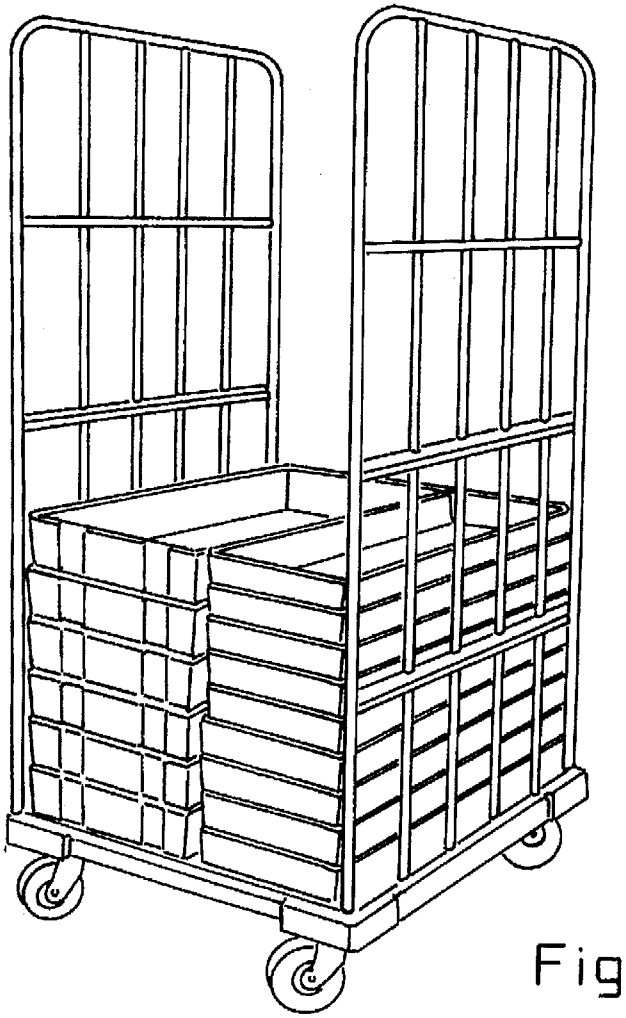
Figure 13:
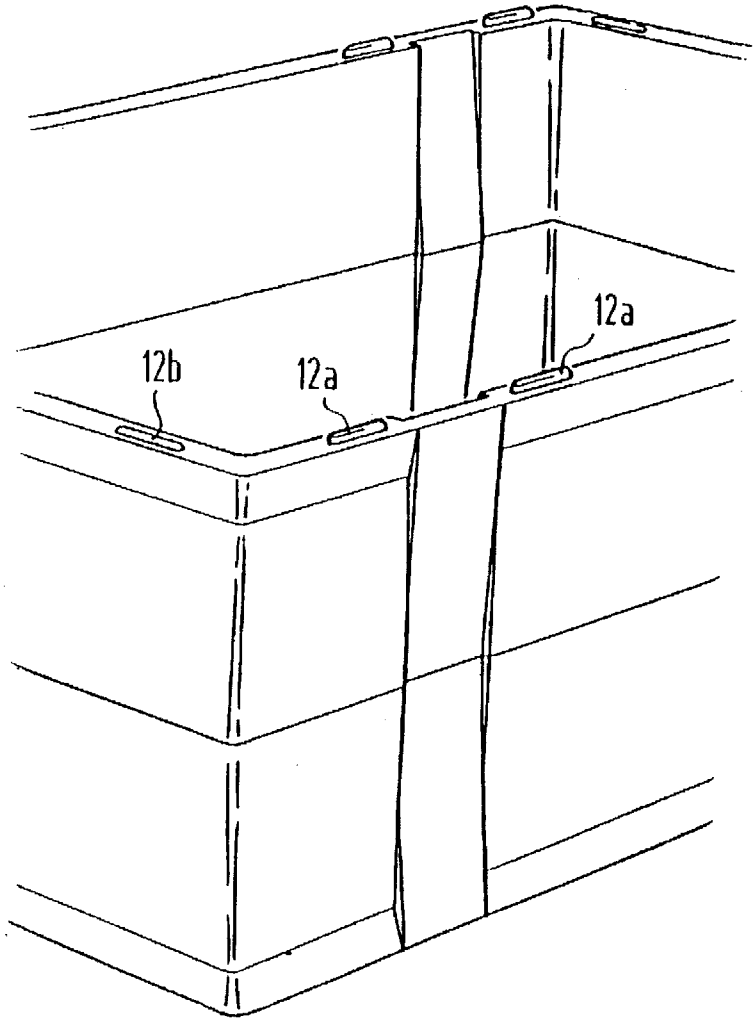
Figure 12:
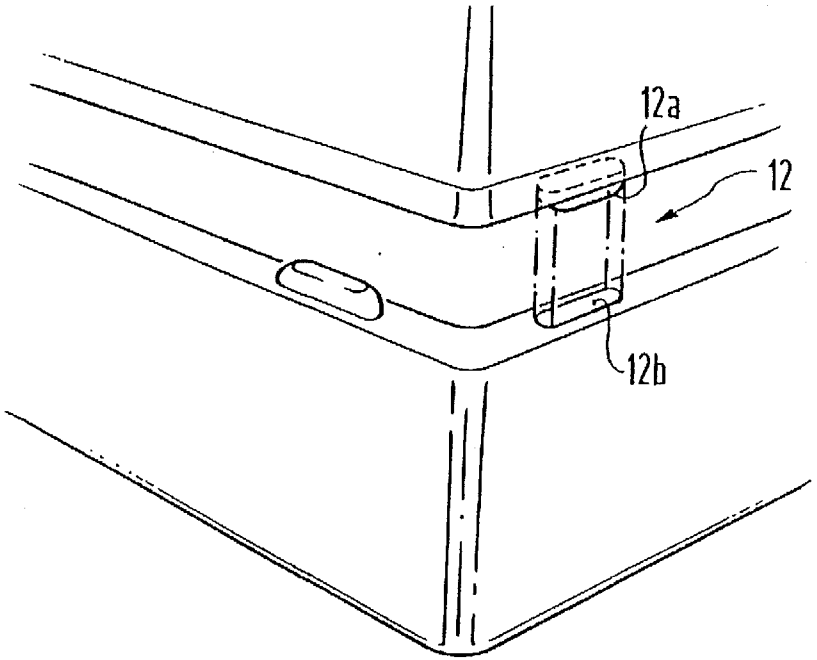
Figure 14:
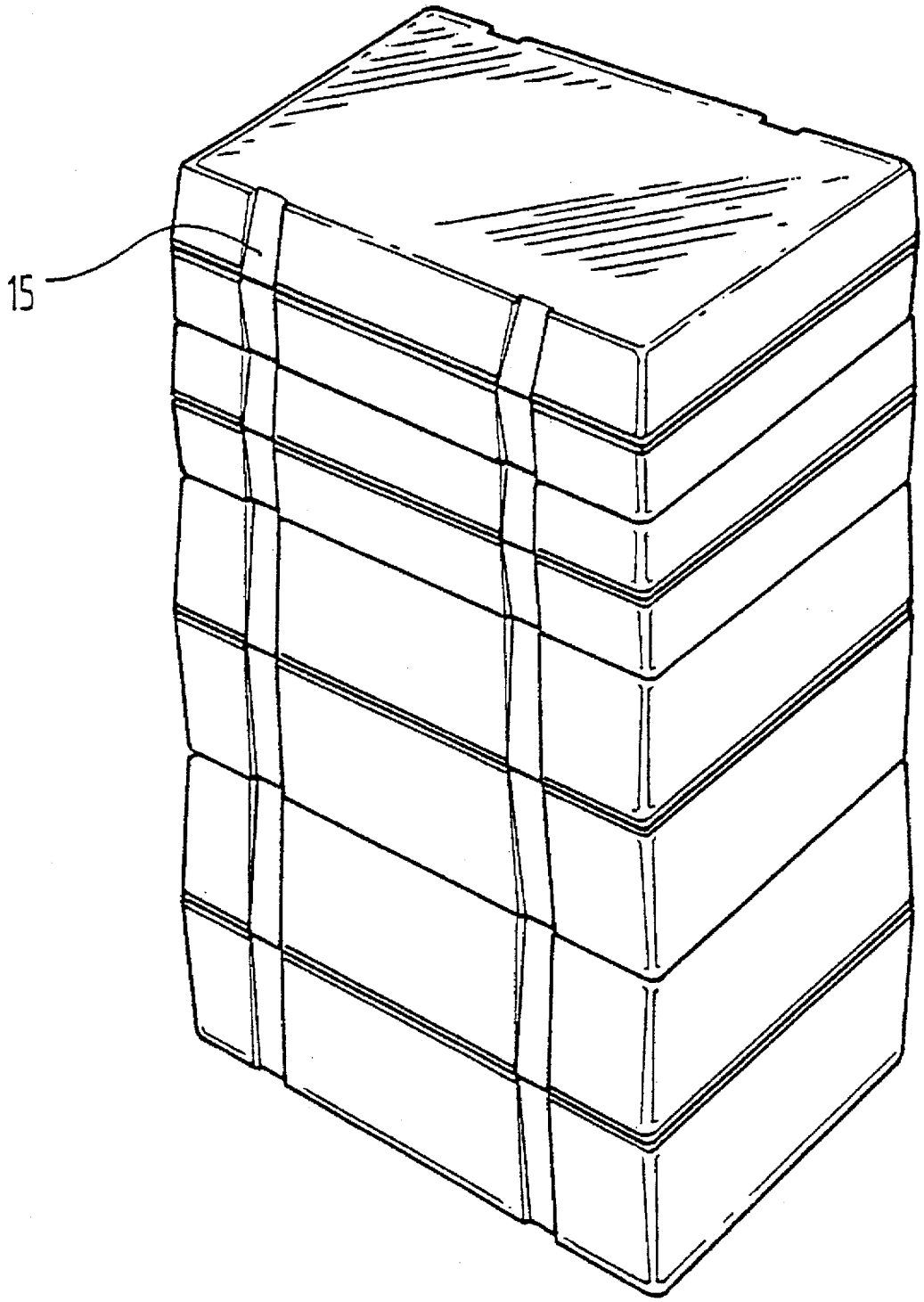

FIG. 8 shows a larger representation of basic elements 7, 8 and 9. FIG. 9 shows a container in an exploded representation that is formed of a basic element 7 as the bottom portion, two frame elements 9 as frame walls, and a basic element 7 as the cover, the basic elements being held by two tightening straps. For fixing the basic elements to one other, tongue-and-groove formations are provided in the opposing edge sides of the basic elements. These tongue-and-groove formations are designated in general as 12. These tongue-and-groove formations are disposed in mirror-inverted fashion on the opposing sides so that the basic elements are usable in any manner as required. As indicated in particular by FIG. 9, the basic elements are inclined outward slightly conically once again on the top edge portion at 13, this cone angle being somewhat greater than the cone angle of lower portion 14 of the basic elements. FIG. 11 shows a multiplicity of containers, each constructed from basic elements 7 to 9 in a stacked position, as they can be accommodated on a pallet. On the left of the Figure the basic elements are shown stacked in one another in the empty state. As a comparison of FIGS. 11 and 11A shows, there is a substantial space saving in the stacked state, the basic elements stacked in one another requiring 70% less space than the assembled containers on the right. FIG. 12 illustrates the groove-and-tongue principle. FIG. 13 shows the different arrangement of the groove and tongue formations in opposite side walls, a tongue formation **12*a* on one side wall being associated with corresponding groove formation 12*b* on the opposite side wall. In the embodiment of FIG. 14 the basic elements of each container are held together by slip-on tightening elements 15**. Other suitable fastening mechanisms can also be realized.

Figure 15:
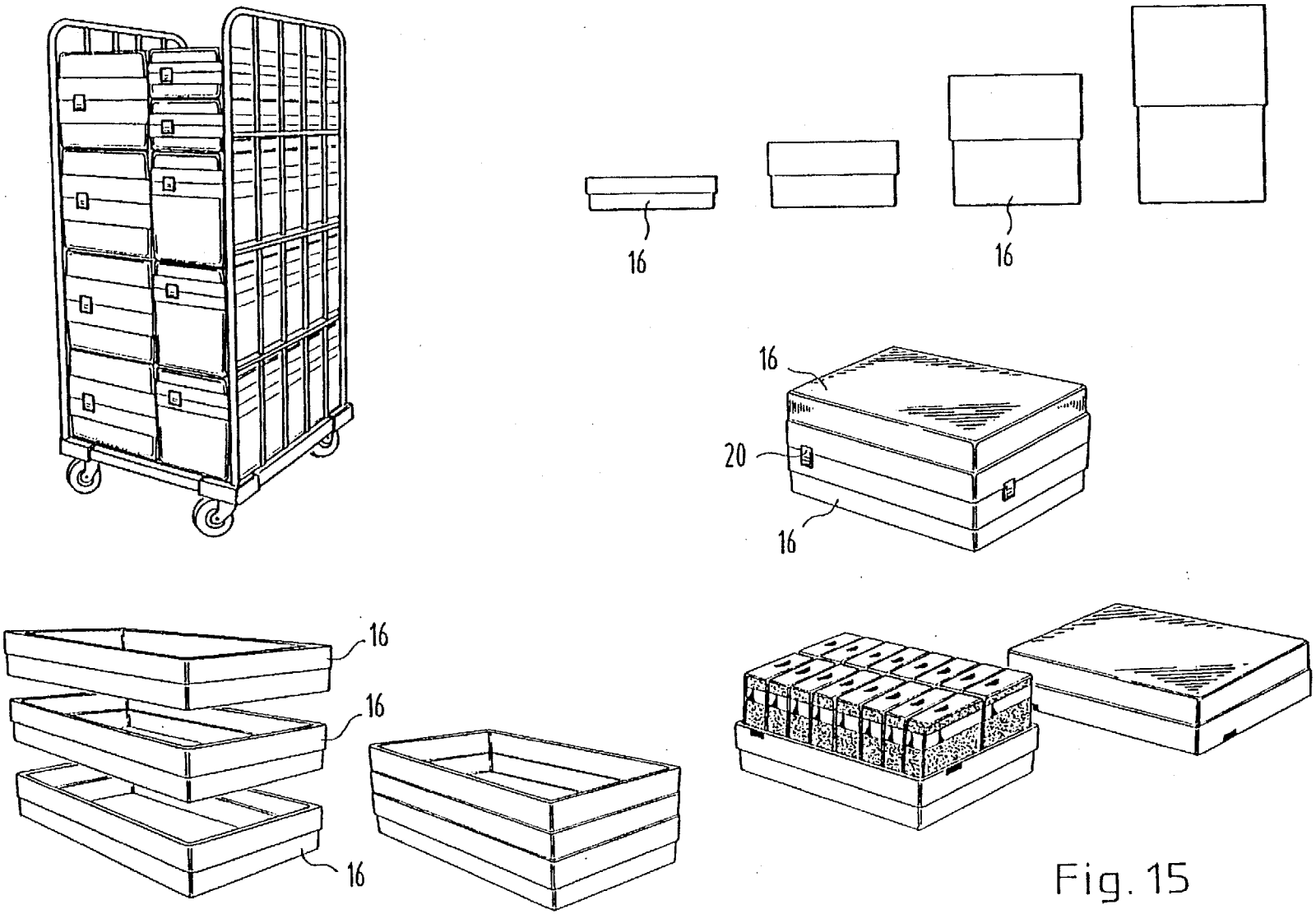
Figure 17:
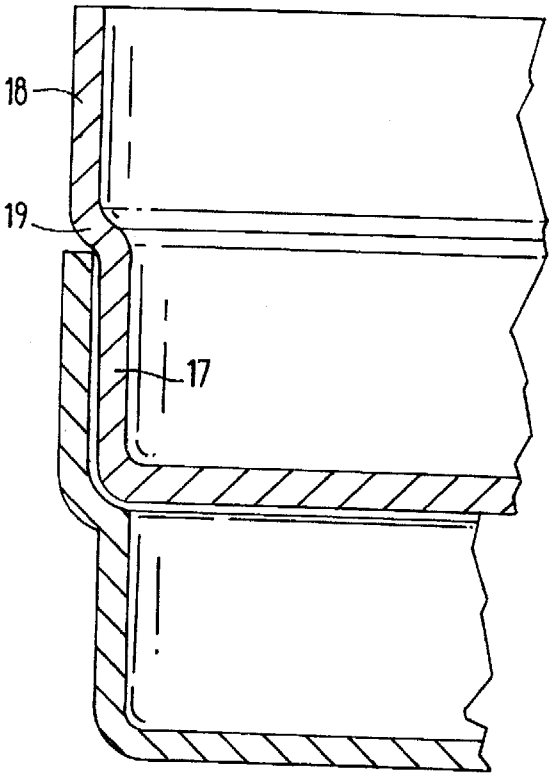
Figure 16:
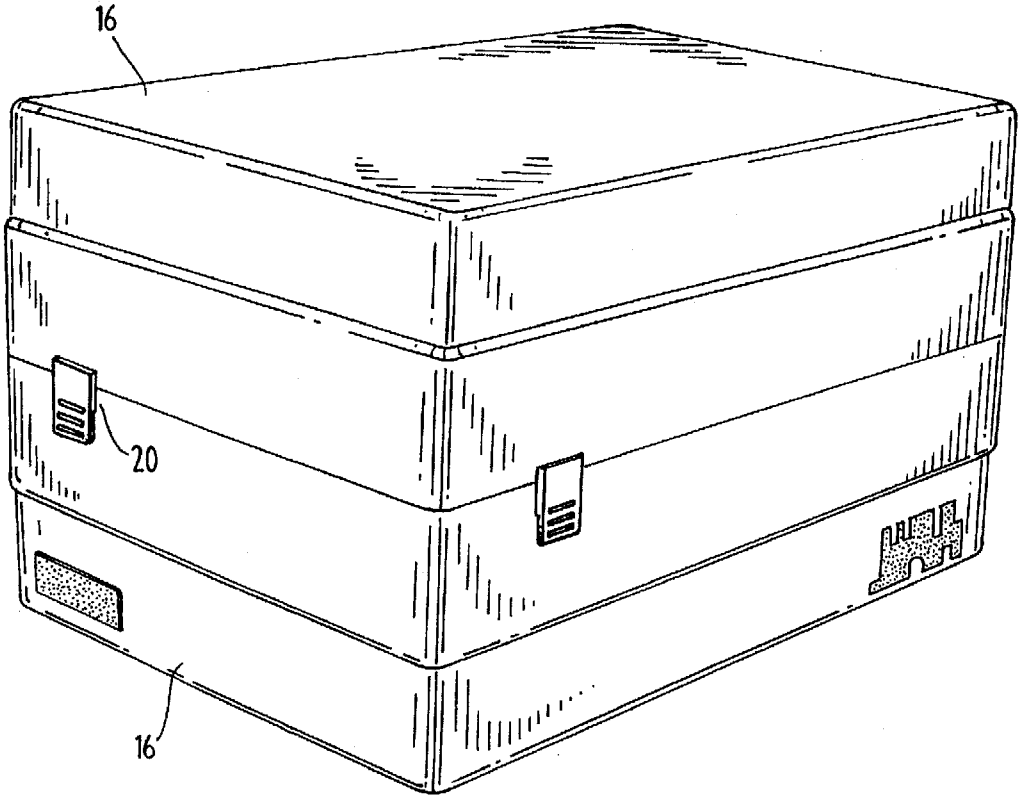
Figure 18:
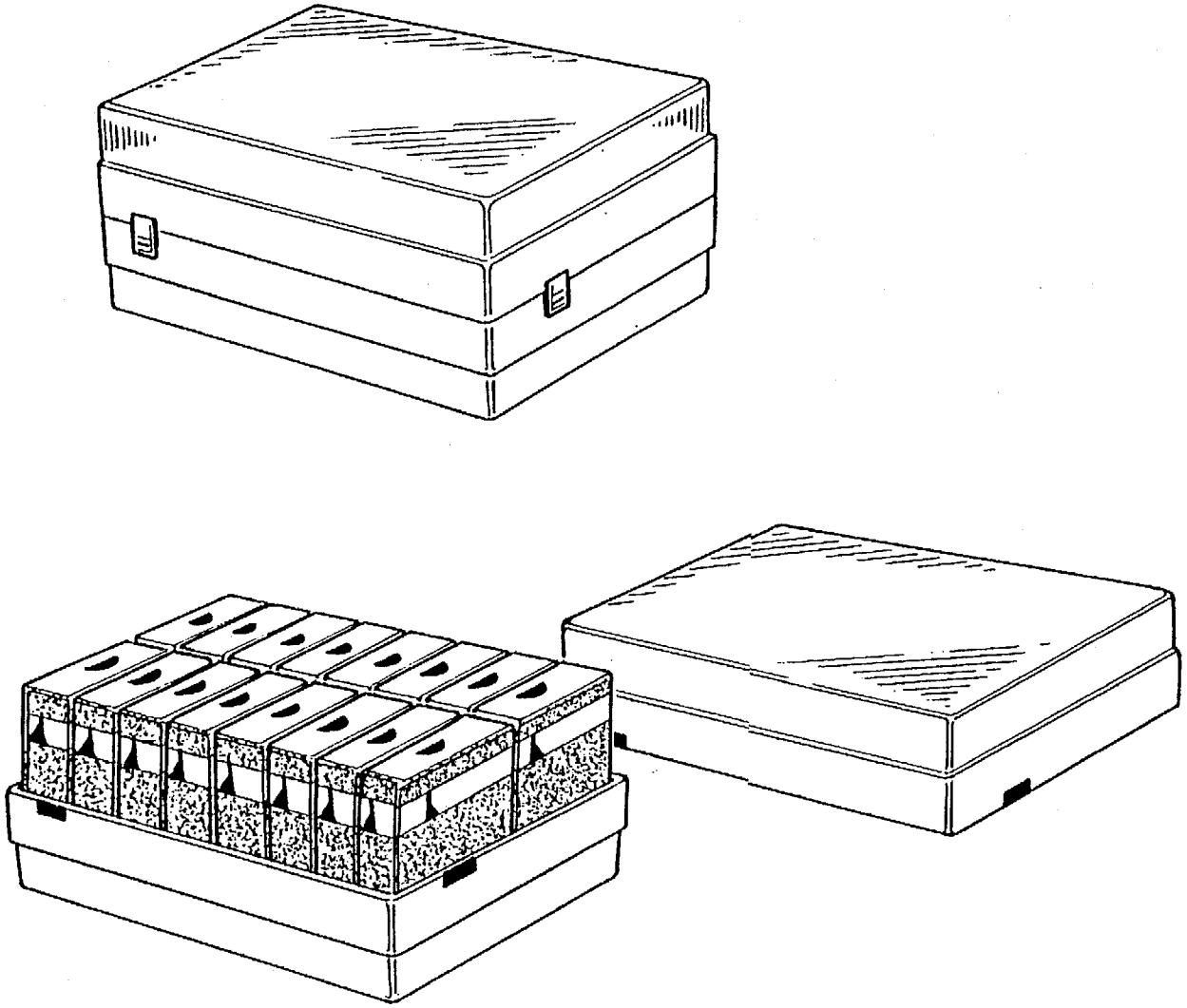
Figure 19:
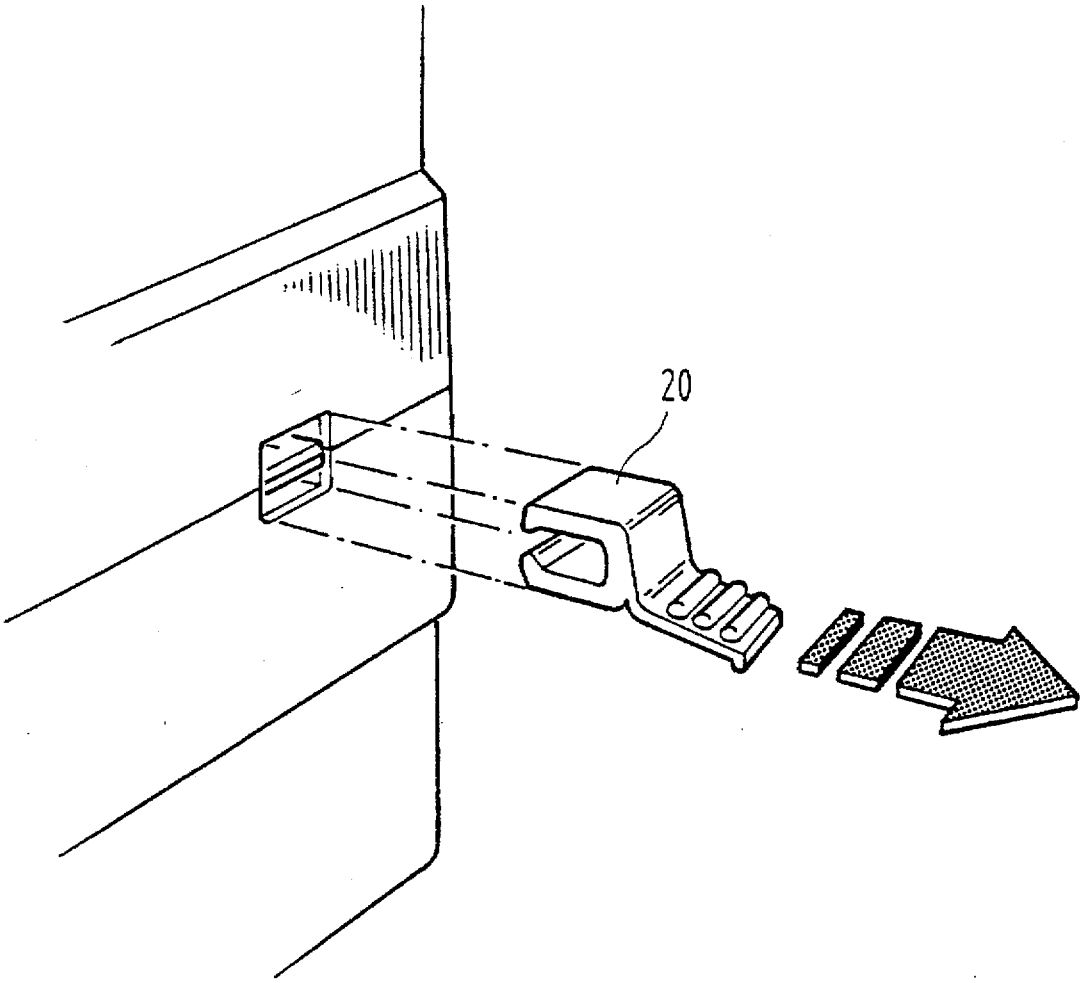
Figure 20:
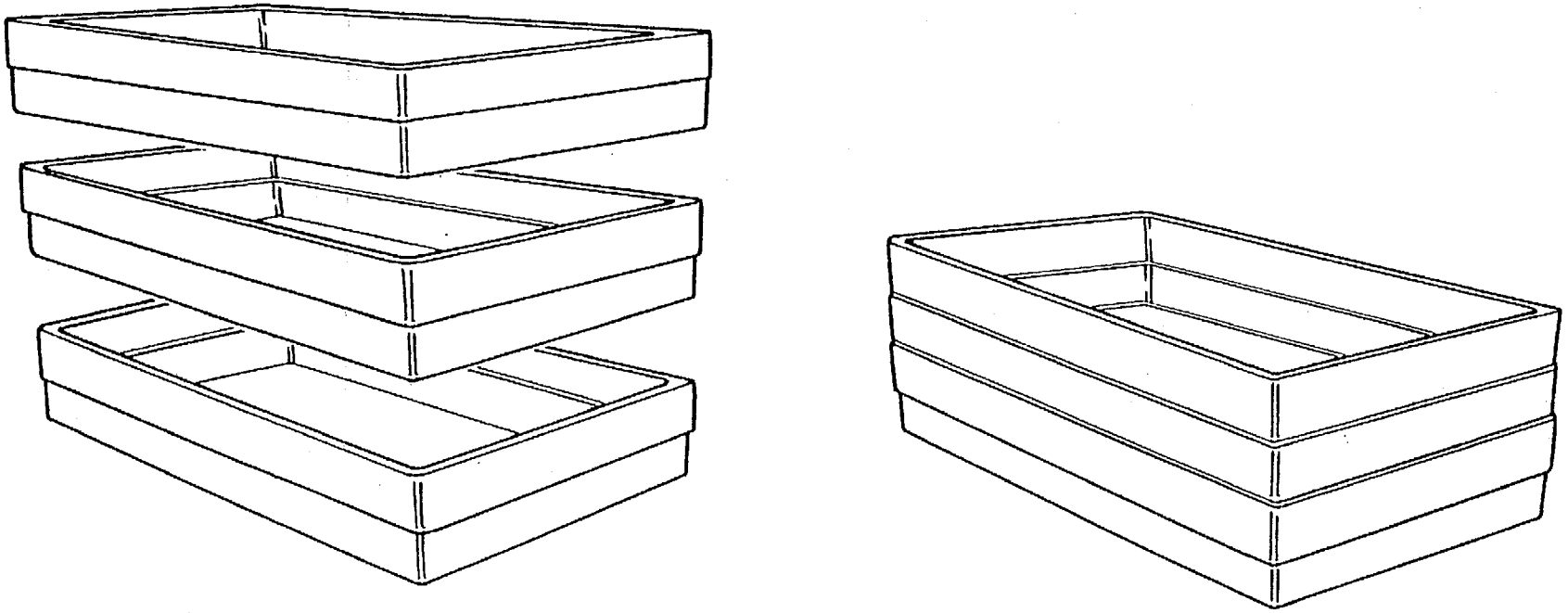

The embodiment of a container system as in FIGS. 15 to 20 is characterized by a uniform basic element 16. i.e. a basic element comprising surrounding side walls and a bottom that is graduated in height, as apparent from FIG. 15 on the top right. Basic elements 16 with different heights again permit a wide range of packaging or transport containers to be realized, as shown by FIG. 15 on the top left. As best indicated by FIG. 17, this basic element 16 has a lower wall portion 17 and an upper wall portion 18 that is shifted slightly outward from lower wall portion 17, two wall portions 17 and 18 being interconnected via a shoulder 19. Obviously, these basic elements are expediently formed integrally of plastics, as in the previous case. Due to this design the empty basic elements can be stacked in one other well, resulting in a space saving of 50% over the container assembled from the same basic elements. The nesting principle is also illustrated by FIG. 15 on the bottom left. The containers are formed in this system by stacking two basic elements of the same or different heights with the upwardly open ends in each case. Here, too, one can provide tongue-and-groove formations in the opposing edge sides for fixing the assembled basic elements. However, FIG. 19 shows a clip that can be snapped over mating edge formations of the basic elements from outside after the latter have been combined into a container, thereby locking the basic elements together to form a container. Removing snap elements 20 unlocks the container, so that the cover can be removed and the lower basic element placed on a shelf as a display package, for example. These snap connections are expediently provided on all four side walls of the basic elements, whereby the lock can also take place only on opposite side walls if required. This can be seen fairly clearly in FIG. 16, for example. If required further basic elements can be used, e.g. a basic element 16 without a bottom, which widens the possible variations of the container system.

Figure 21:
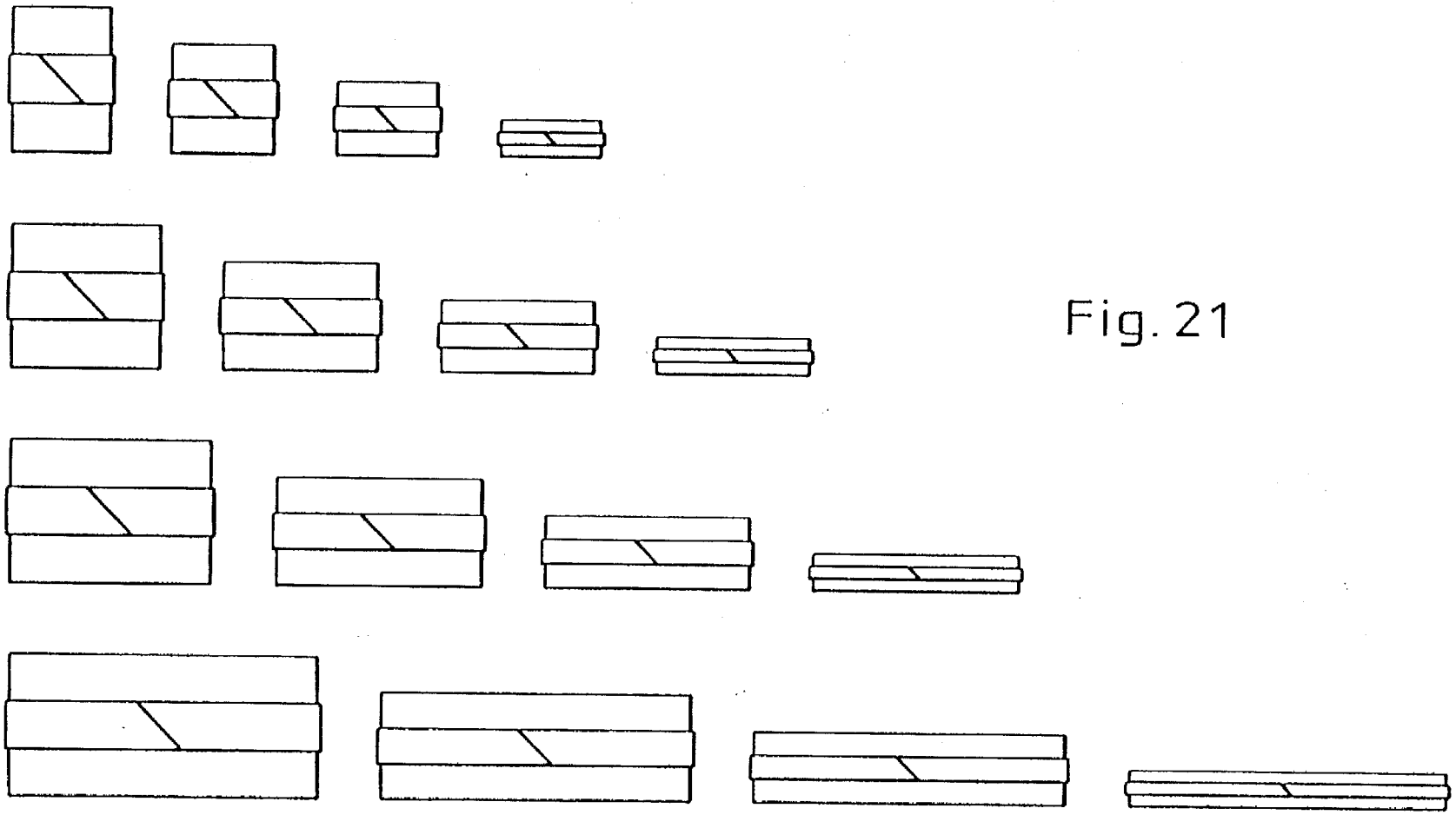
Figure 22:
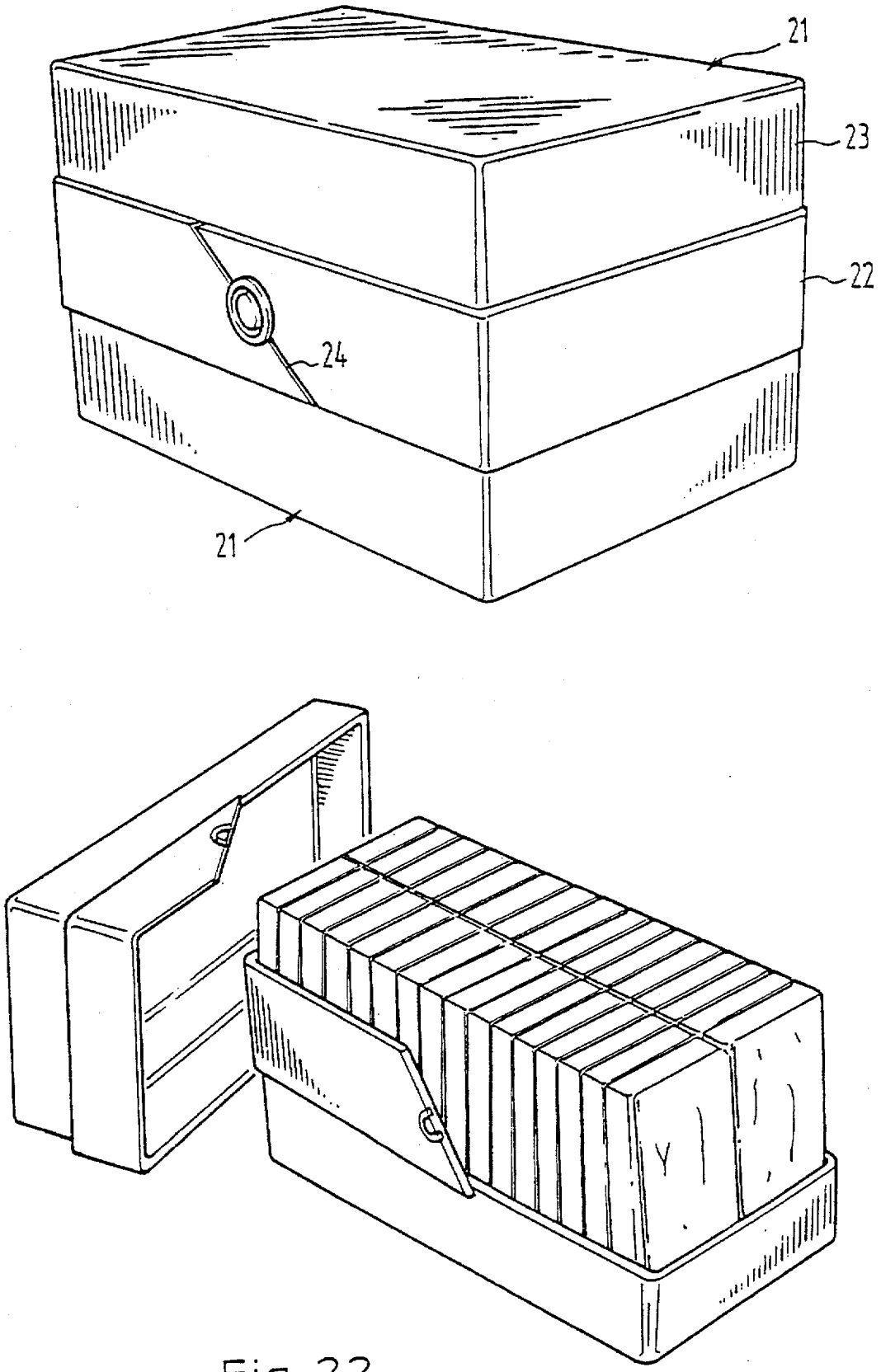
Figure 23:
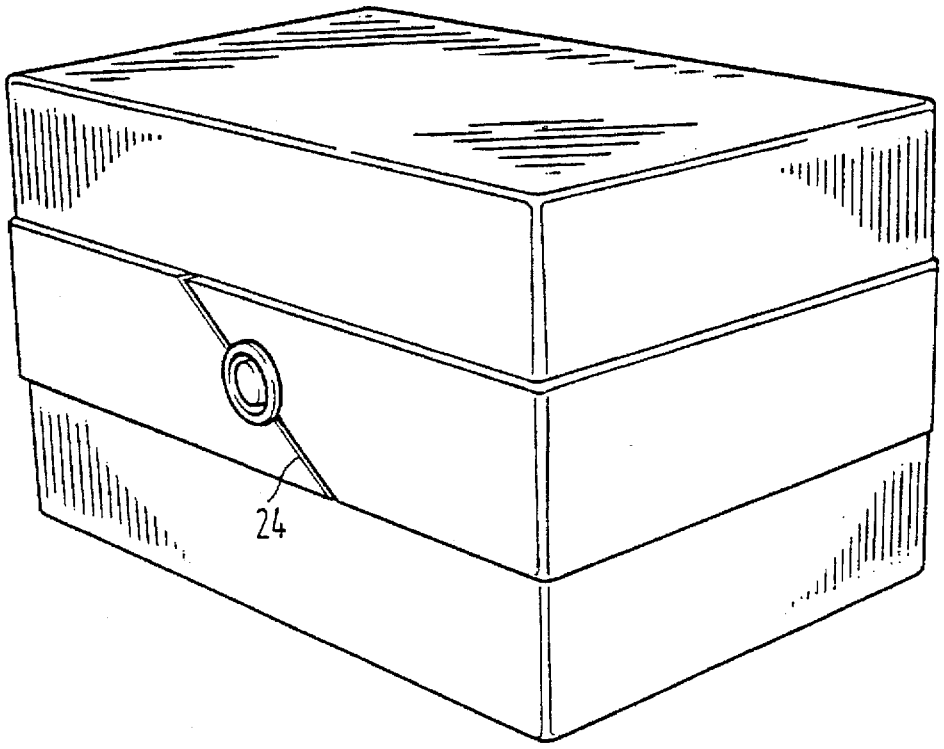
Figure 24:
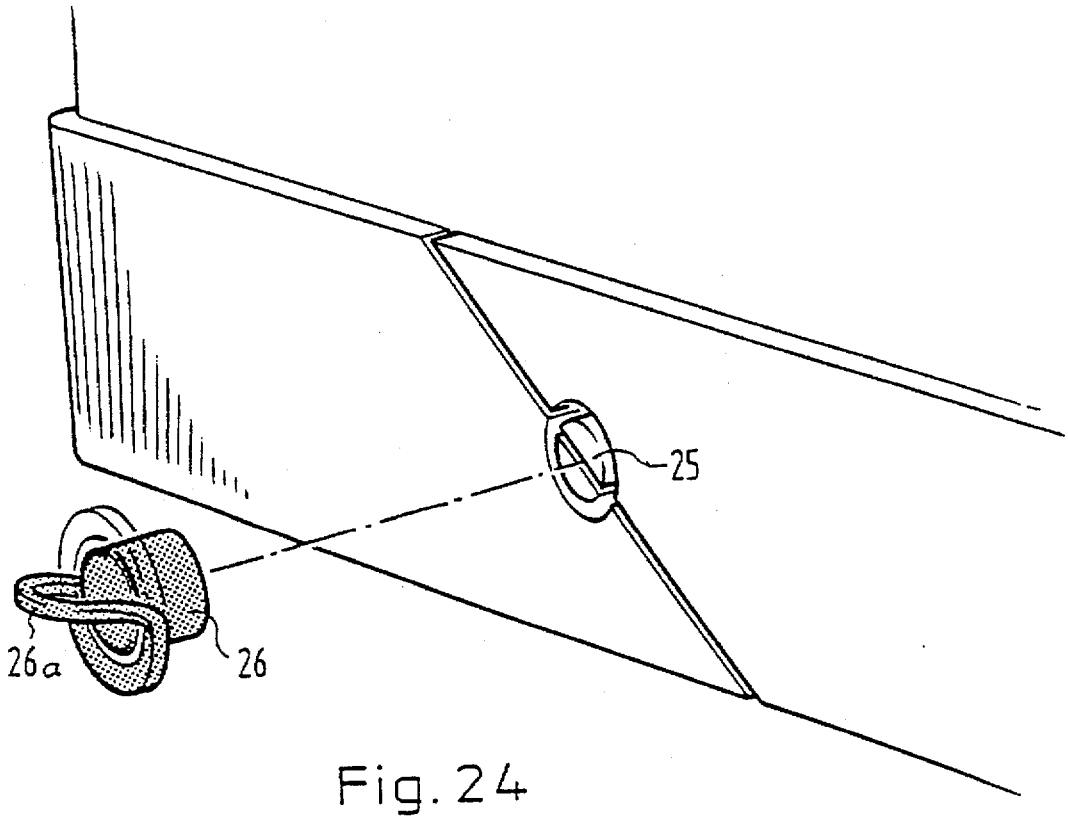

The container system of FIG. 21 and the following figures has certain similarities to the container system in FIGS. 15 to 20, but in the otherwise identically designed basic elements only half of outward shifted upper edge portion 22 is formed in the area of the longitudinal side walls and ended by an obliquely extending edge portion 24. This container system has the advantage that when the upper half is lifted off the lower half results in a corresponding display package or display container wherein the back area constitutes a support for the goods taken up in the package. A slightly conic design of the side walls permits here, too, the stackability of individual basic elements 21. Due to different heights of basic elements 21 different exemplary combinations of containers can be formed, as are shown for example in FIG. 21. FIGS. 23 and 24 show a fastening mechanism whereby a button 25 can be fitted from the longitudinal side of the basic elements over a projection 25 formed in the basic elements. Projection 25 is composed of two halves, each half being associated with a basic element. The button is pulled out to open the container via a flap 26 that can be pressed into a recess after the button has been slipped onto the projection so that this flap does not protrude outward in the state of use of the container.

The individual basic elements are expediently each produced integrally, whereby a collapsible design of the frame elements might also be suitable, in which case the side walls of the frame elements are interconnected via a film hinge or an articulated hinge. This would offer the advantage that the frame elements could then be transported folded up in the empty state. It is also possible to divide the frame elements into individual frame walls that can be assembled via tongue-and-groove joints.

Figure 25:
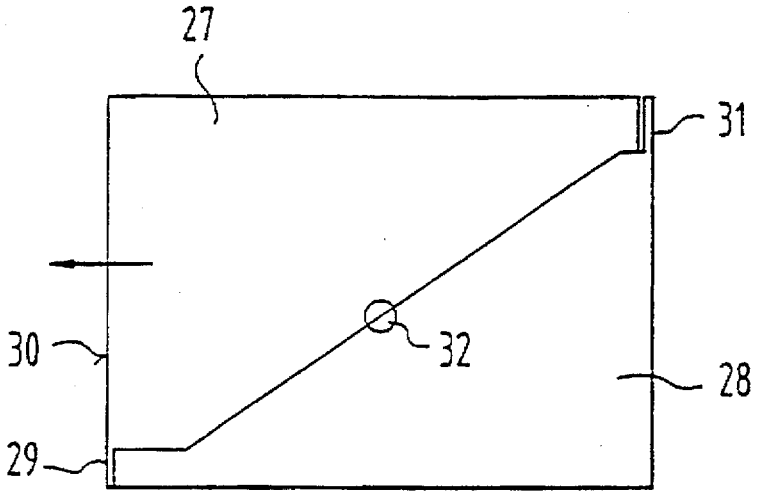

FIG. 25 shows an embodiment similar to the container shown in FIG. 23, but here upper container portion 27 can be removed laterally, i.e. toward the front, relative to lower container portion 28, as indicated by the arrow. This offers the advantage that when the container composed of elements 27 and 28 is placed on a shelf the container can be readily opened by removing upper container element 27, so that the goods taken up in lower container element 28 are then placed on the store shelf as a sales unit. For this purpose it is expedient to provide upper container element 27 with a downward protruding projection 29 in the manner of a strip that can be formed integrally with end wall 30 and serves as a stop element on lower container element 28. In the embodiment example shown, an upward directed strip 31 is likewise provided on the back wall relative to lower container element 28 in order to give the two assembled container elements a better hold. Number 32 refers to a closing means for the container that can be designed in a particularly simple way in the functional manner of a crown cork stopper and is provided to both sides of the container. This is a very easily produced and easily operated closing element, which furthermore offers an assurance of originality because the first opening of the container causes a corresponding deformation of the crown cork so that manipulation in the sense of an opening of the container is immediately noticed. This of course means that the crown cork engages over a ring formed by container elements 27 and 28 on which the crown cork is anchored in order to fasten elements 27 and 28.

Figure 26:
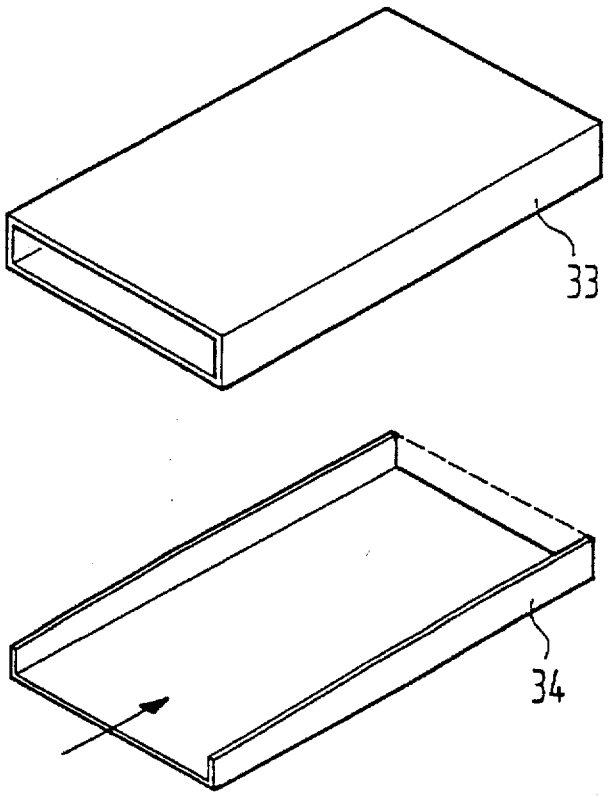

FIG. 26 shows the dismountability of the container, which is very essential to the invention, whereby an upwardly and downwardly open frame element 33 is adapted to be assembled with a bottom in the manner of a tray 34, bottom 34 being in the manner of a drawer in which frame element 33 is insertable in accordance with the arrow. In the simplest embodiment bottom 34 is trough-shaped, i.e. flanges with a small wall height are formed on the two opposite edges of the bottom plate and, in a development, the back wall can also be formed in the manner of a flanged wall, as shown by the broken line.

Figures 27, 28:
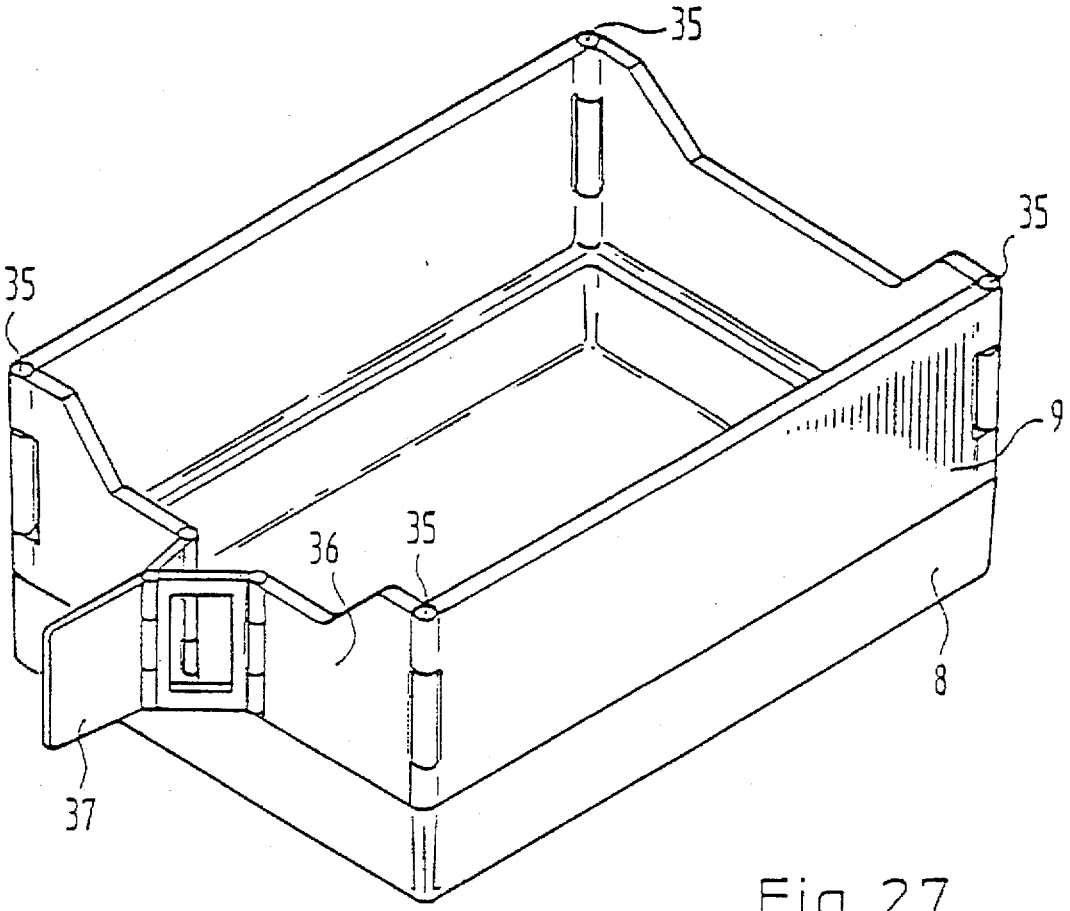
Figure 29:
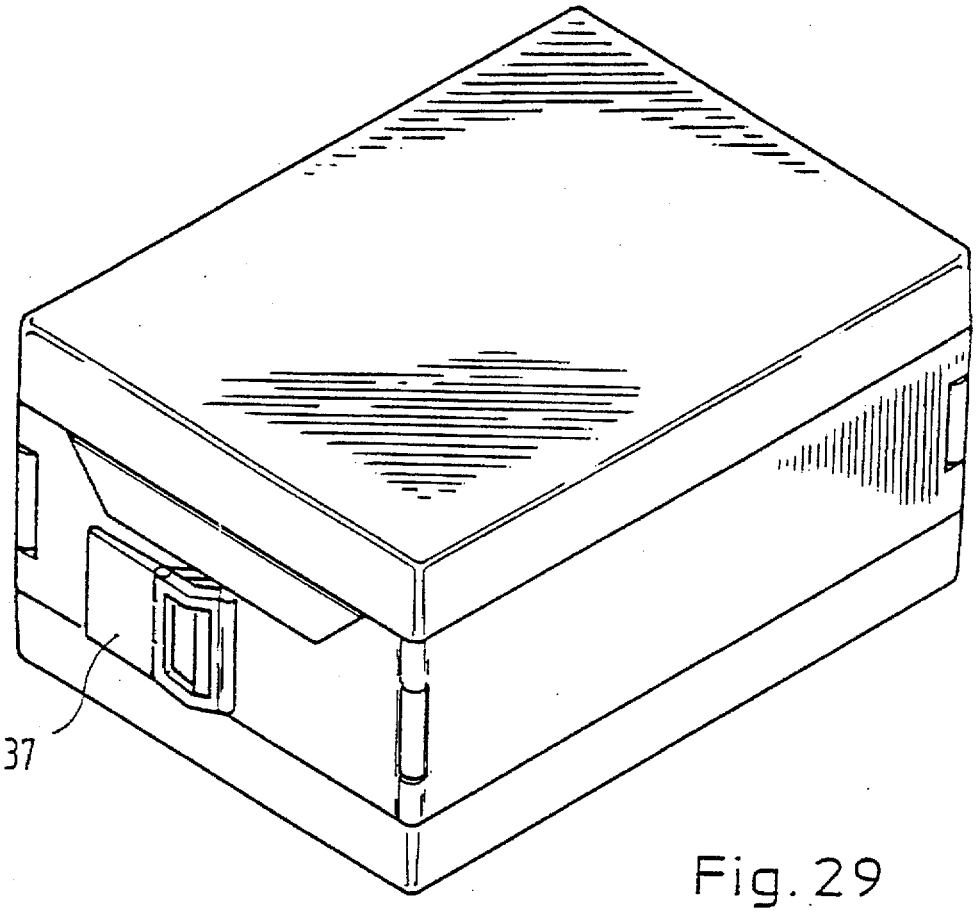
Figure 30:
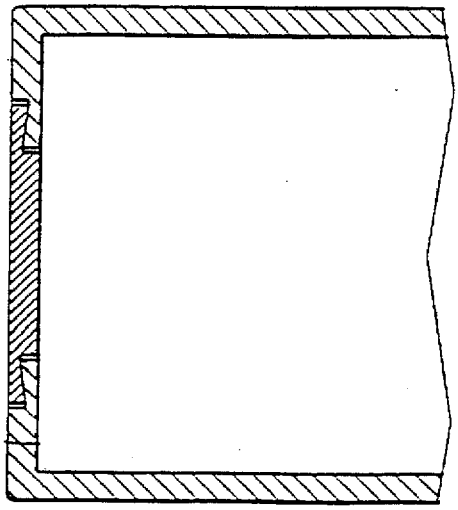

FIGS. 27, 29 and 30 show an embodiment in which frame element 9 is designed in principle like the embodiment in FIGS. 7 to 14, i.e. is upwardly and downwardly open. The special feature is that this frame element 9 as in FIG. 27 is at the same time designed as a fastening means since joints are formed in the corners at 35 and frame element 9 is divided on its narrow wall 36 so that the frame element can be folded up. Due to tightening and closing mechanism 37 frame element 9 can be tightened and closed so that it at the same time constitutes the fastening means. The tightening means and closing means used is a mechanism similar to the tightening and closing mechanism of a baking mold, i.e. a fold-over clamping flap that in the folded-over dead position holds frame element 9 tightened and closed. According to FIG. 27 frame element 9 is seated on a bottom element 8. FIGS. 29 and 30 show details of this embodiment.

FIG. 28 shows a table, the column "Outside" stating longitudinal dimensions of a container on the outside and the column "Inside" the longitudinal dimensions of the same container on the inside. The column "Wall" contains the thickness dimensions of the walls. The stated dimensions, that serve only as an example of the intended graduation of the dimensions, permit very good stackability of the containers with different sizes. The essential feature is that the thickness of the wall of the next larger container is designed thicker in accordance with the ratio of the length of the side walls. With an outside dimension of 600 mm for the larger container and an outside dimension of 300 mm for a smaller container, for example, the wall thickness of the smaller container is 10 mm while the wall thickness of the larger container is 20 mm. One thereby takes account of the fact that with the stated dimensions two smaller containers can be placed on a larger container, for example. Since the two smaller containers then bring two additional walls, however, a flush end of the containers in the stack is ensured if there is a corresponding enlargement of the wall of the larger container that takes up the dimension of the thicknesses of the two additional walls of the smaller container. If the outer dimensions of the smaller container are 400 mm the wall thickness of the smaller container is 15 mm. The corresponding graduations result from the table in FIG. 28 for various adapted outer dimensions of a modular container system.

Figure 31:
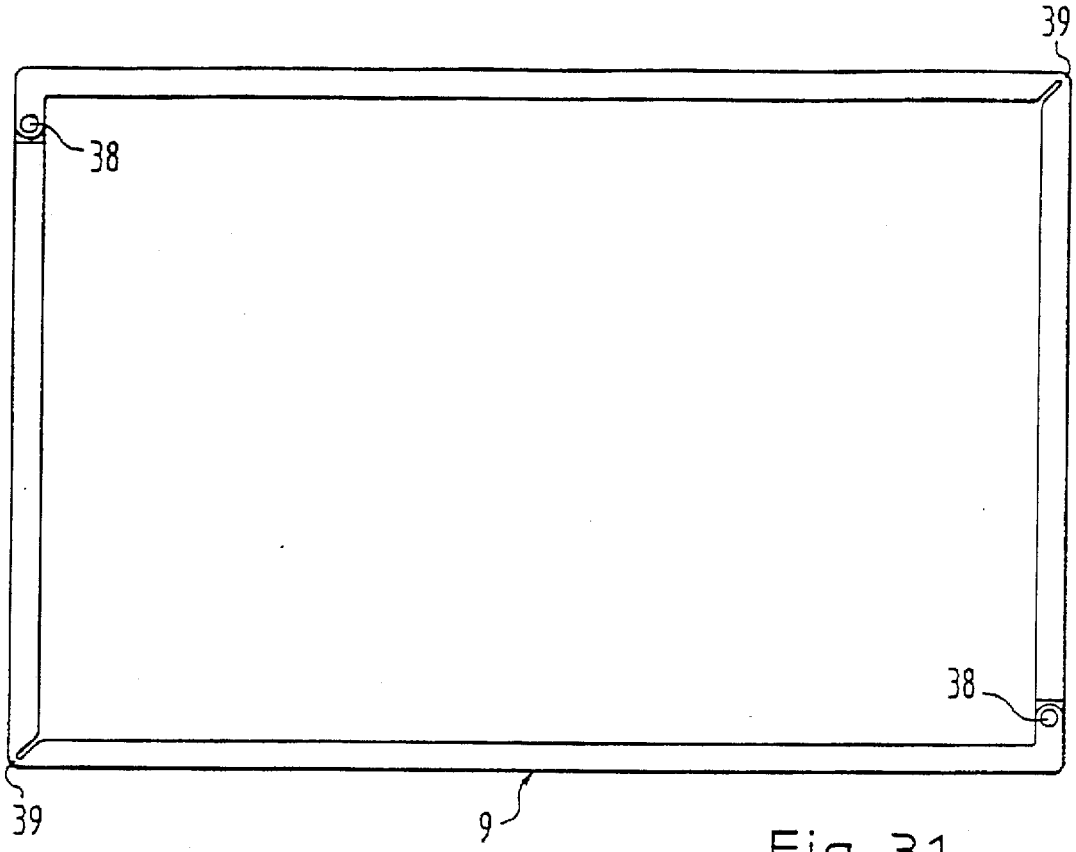
Figure 32:
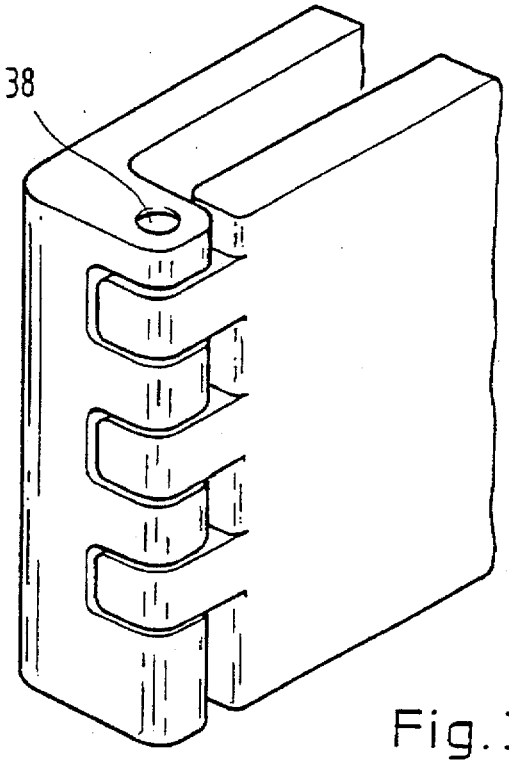

FIG. 31 shows a further embodiment of a collapsible frame element 9, the articulated hinges shown in FIG. 32 being provided on two diagonally opposite corners and the two other corners being formed by film-like hinges 39. This permits frame element 9 to be folded up. Articulated hinge 38 as in FIG. 32 is characterized by a long life because several knuckle eyes are realized.

Figure 33:
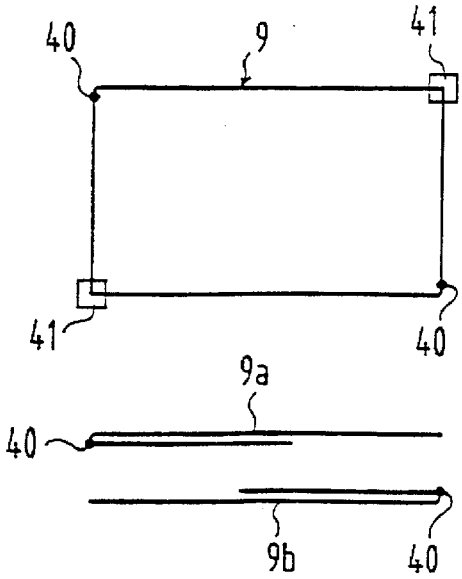

The embodiment indicated only schematically in FIG. 33 shows at 40 the joints in the corner areas of a frame element 9 and at 41 mechanical closing means so that frame element 9 can be divided at 41 giving rise to two frame element halves **9*a* and 9*b*, as shown in FIG. 33 at the bottom. Joint 40 permits halves 9*a* and 9*b*** to be folded up once again.

CLAIM COMPLEXES

1) A container system constructed of modular basic elements that are combinable with each other to form a packaging or transport container.

The basic elements are adapted to one other. Four basic elements (1 to 4) are preferably used that have the same basic dimensions but differ in height. The difference in the heights is expediently stepped or graduated: it is particularly expedient if a basic element has a height of 37.5 mm, the next larger a height twice as high, namely 75 mm, the third element a height of 150 mm, i.e. twice the height of the lower basic element, and the fourth basic element a height corresponding to the overall height of the basic element (2) and the basic element (3). If required, other graduations, in particular other heights, are also suitable.

The basic elements themselves comprise a bottom and side walls, the side walls being closed all the way around. However, recesses can expediently be disposed in the side walls to form handles. The side walls are expediently conically inclined outward, at a small cone angle, so that the empty basic elements can be stacked in one another.

The containers are formed by assembling two basic elements in each case that are joined with their open ends toward each other. It is possible to connect the basic elements, whereby in particular tongue-and-groove joints are formed on the upper edges of each basic element, expediently in mirror-inverted fashion on opposite side walls.

The lock or fastening of two basic elements to form a container is made possible by suitable fastening mechanisms, e.g. a pivoted lever or bolt or clamp clip to be operated from the outside and engaging over, in or being braced with a corresponding element in the other basic element of the container.

2) A container system corresponding largely to claim complex 1) but preferably comprising three basic elements, namely basic element (7) as a tray or cover, basic element (8) as a tray or cover, and basic element (9) as a frame. Basic element (9) comprises only side walls and has no bottom. The other two basic elements have not only the side wall but also a bottom. By using any desired number of frame elements (9) one can conceive containers of different heights comprising a lower basic element (7) or (8), an upper basic element (7) or (8), and frame elements (9) disposed therebetween.

The basic elements are expediently fixed to form a container by tightening straps, strings or the like. Tongue-and-groove joints are also suitable for locking the basic elements in the assembled position. The conic design of the side walls permits stackability.

It is again expedient to graduate the height of the side walls. In a preferred embodiment the lowest basic element has a side wall height of 37.5 mm, the further basic element (8) twice this height and the frame element the same height as the higher basic element (8). A different dimensioning of basic elements (8) and (9) in terms of their height is of course also possible assuming a different side wall height of basic element (7). The graduation of the height of the side walls can also be different. The container system can expediently be expanded by adding frame elements of different heights.

3) Third claim complex:

A container system comprising basic elements that differ in height. Each basic element has a bottom and a lower side wall portion followed by an upper side wall portion that is shifted slightly outward all the way around. The transition between the upper and lower edge portions is expediently formed by an integral shoulder. The basic elements are expediently graduated in height. A preferred graduation is height h for the lowest container, 2 h for the next larger container, 3 h for the next container and nh for the following containers, whereby n is an integer.

If required one can also integrate frame elements here that are based on the basic element but have no bottom. The basic elements can be nested into one other due to the special design. Here, too, suitable fastening elements can be used, as in the other claim complexes, to fix the corresponding basic elements to form a stable container. As in the other claim complexes, a snap element is suitable here which can be inserted from the outside into recesses in the walls of the basic elements so as to engage over and hold together two formations of two basic elements.

4) Claim complex of a further container system:

A container system consisting of basic elements, largely analogous to claim complex (3), but only half of the upper wall portion is provided since the upper wall portion extends over a narrow side and only halfway on both longitudinal sides opposite. The upper wall portion ends on its two longitudinal sides by a sloping area. Stacked basic elements overlap in the sloping area.

Here, too, fastening elements can be used as in the previous claim complexes: in particular it is suitable to use, as in the other claim complexes, a slip-on button that engages over a protection on two basic elements, thereby holding the two basic elements together.

I claim:

1. A container system for forming containers made of injection molded plastics, characterized in that the containers are built up from system-compatible modular basic elements including tray elements and frame elements that are combinable with one another to variably form different transport and packaging containers in order to ensure a versatile system; said frame elements comprising a continuous generally rectangular peripheral wall and having open top and bottom ends; said tray elements comprising a continuous generally rectangular peripheral wall, a bottom wall and open top end, the height of said peripheral walls of at least one of said tray elements being less than the height of said peripheral walls of at least one of said frame elements; whereby said frame elements are stackable on one another and also stackable on said tray elements to form containers having varying heights; and said peripheral walls of said modular basic elements being tapered outwardly at a slight angle, and said modular basic elements preferably have the same basic dimensions except for their height dimension, the height of the basic elements being multiples of the shortest basic element height.

2. The container system of claim 1 characterized in that the modular basic elements are designed in such a way as to be at least partly nestable in one another.

3. The container system of claim 1 characterized in that the height of said modular basic elements is a multiple of 37.5 mm.

4. A container system for forming containers made of injection molded plastics, characterized in that the containers are built up from system-compatible modular basic elements including tray elements and frame elements that are combinable with one another to variably form different transport and packaging containers in order to ensure a versatile system; said frame elements comprising a continuous generally rectangular peripheral wall and having open top and bottom ends; said tray elements comprising a continuous generally rectangular peripheral wall, a bottom wall and open top end, the height of said peripheral walls of at least one of said tray elements being less than the height of said peripheral walls of at least one of said frame elements; whereby said frame elements are stackable on one another and also stackable on said tray elements to form containers having varying heights; said modular basic elements being designed in such a way as to be at least partly nestable in one another; said peripheral walls of said modular basic elements being tapered outwardly at a slight angle, and said modular basic elements preferably have the same basic dimensions except for their height dimension, the height of the basic elements being multiples of the shortest basic element height; and the height of said modular basic elements is a multiple of 37.5 mm.

* * * * *